US008038584B1

(12) United States Patent
Pruessner et al.

(10) Patent No.: US 8,038,584 B1
(45) Date of Patent: Oct. 18, 2011

(54) METHOD AND APPARATUS FOR PRACTICING YOGA IN AND AROUND TREES

(76) Inventors: Hal Pruessner, Richardson, TX (US); Debra P Pruessner, Richardson, TX (US)

( * ) Notice: Subject to any disclaimer, the term of this patent is extended or adjusted under 35 U.S.C. 154(b) by 13 days.

(21) Appl. No.: 12/284,994

(22) Filed: Sep. 26, 2008

(51) Int. Cl.
*A63B 21/002* (2006.01)
*A63B 26/00* (2006.01)

(52) U.S. Cl. ..... 482/91; 482/143

(58) Field of Classification Search ..... 482/91, 482/904, 910, 95, 96, 142–14; 182/6, 9, 182/133; 119/728, 769, 770
See application file for complete search history.

(56) References Cited

U.S. PATENT DOCUMENTS

| | | | | |
|---|---|---|---|---|
| 864,188 | A | 1/1907 | Paterson | |
| 1,851,080 | A * | 3/1932 | Becker | 182/6 |
| 3,752,474 | A | 8/1973 | Macabet | |
| 4,073,490 | A * | 2/1978 | Feather | 482/129 |
| 4,245,839 | A * | 1/1981 | Trent | 482/92 |
| 4,714,135 | A * | 12/1987 | Bell et al. | 182/6 |
| 4,879,972 | A * | 11/1989 | Crowe et al. | 119/792 |
| 4,951,778 | A * | 8/1990 | Halvorson | 182/9 |
| 5,341,896 | A * | 8/1994 | Amacker | 166/270 |
| 5,624,359 | A | 4/1997 | Dean | |
| 5,807,218 | A * | 9/1998 | Nagatomo | 482/124 |
| 5,921,903 | A | 7/1999 | Lawrence | |
| 5,984,845 | A | 11/1999 | Powers | |
| 6,368,255 | B1 | 4/2002 | Chan-Rouse | |
| 6,729,268 | B1 * | 5/2004 | Costell | 119/726 |
| 7,090,622 | B2 * | 8/2006 | Hetrick | 482/92 |
| 2007/0209869 | A1 * | 9/2007 | Martin et al. | 182/6 |
| 2009/0057360 | A1 * | 3/2009 | Demsky | 224/262 |

OTHER PUBLICATIONS

Janet St.James, 'TreeYoga Linked to lower stress levels', ABC affiliate WFAA-TV, Nov. 10, 2007, Dallas, TX, USA.
Toni Edwards, TreeYoga, Dallas Modern Luxury Magazine, Jan. 2008, p. 104, Modern Luxury Magazine, Dallas Texas, USA.

(Continued)

*Primary Examiner* — Allana Lewin

(57) ABSTRACT

A method and a strong, light weight, portable apparatus useful for assisting a person to safely practice Yoga using a real tree. The apparatus comprises a plurality of strong, flexible, inelastic, continuous loop slings, predominately of Mountain Climbing Specification Nylon tube webbing, connected to one another in an interlocking fashion. This Yoga multi-sling is dimensioned for attachment in a secure manner to most any tree or strong branch; and is designed to comfortably support the user's body or limbs in such a manner as to alter the orientation of one's body with respect to gravity. This method and apparatus empower the user to employ gravity as the exercising or stretching force through the positioning of the user's own body or limbs to create first, second, and third class levers in order to multiply and focus these forces on targeted muscles or muscle groups, and enhance the flow of one's Yoga practice. The Yoga multi-sling enables a person to use a real tree as a strong stretching partner to practice unique, supported, Yoga postures, or asanas, in order to increase one's balance, strength, and flexibility in an outdoor, natural setting. An advantage of connecting to a living tree while practicing Yoga is the medicinal and therapeutic enhancement of the five senses to produce an overwhelming sensation of peace to one's mind, body, and soul. The inexpensive multi-sling, which fits in a drawstring backpack tote, is adaptable to various body types, reconfigurable, comfortable, and tree friendly.

1 Claim, 25 Drawing Sheets

OTHER PUBLICATIONS

Figure 1:
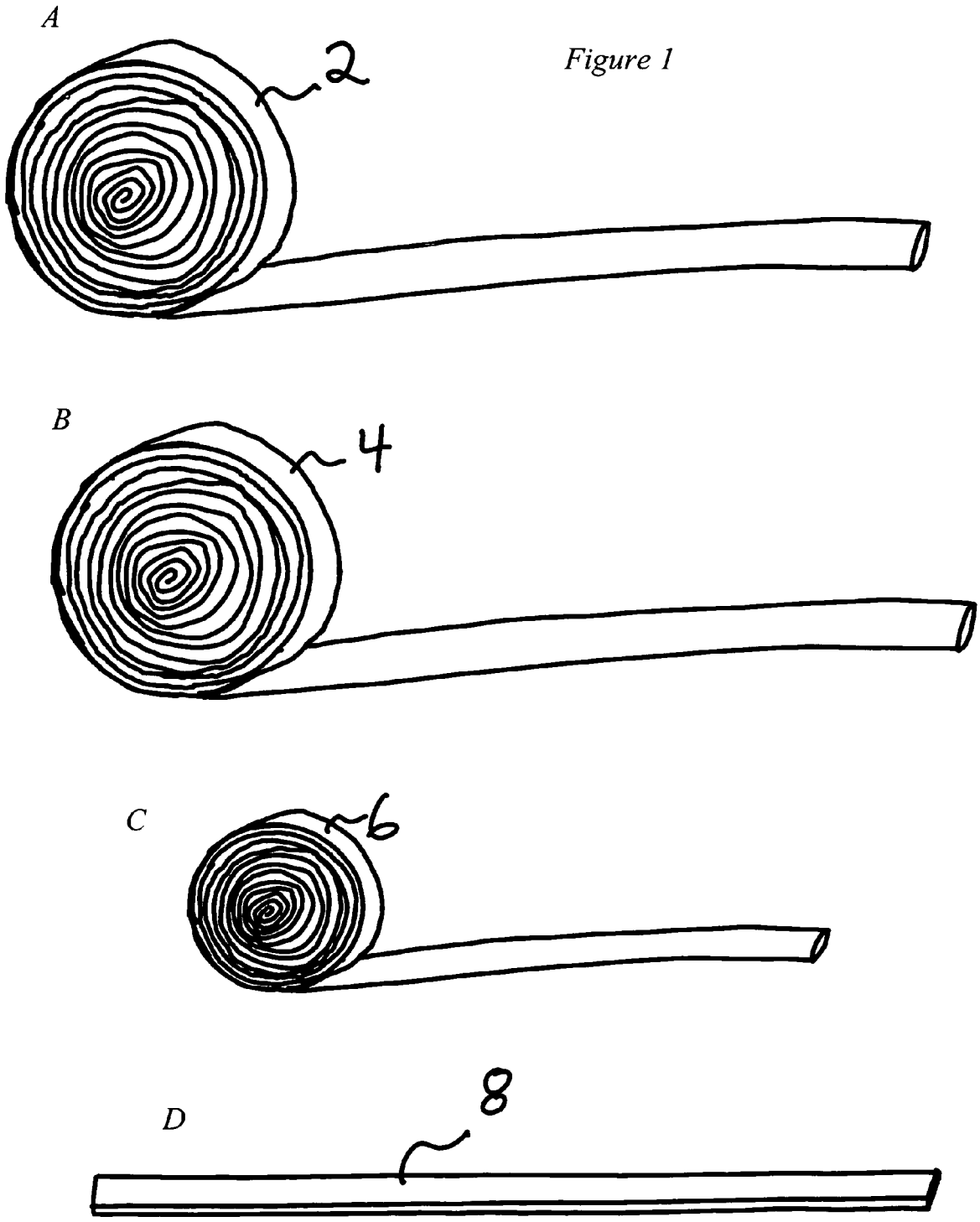
Figure 2:
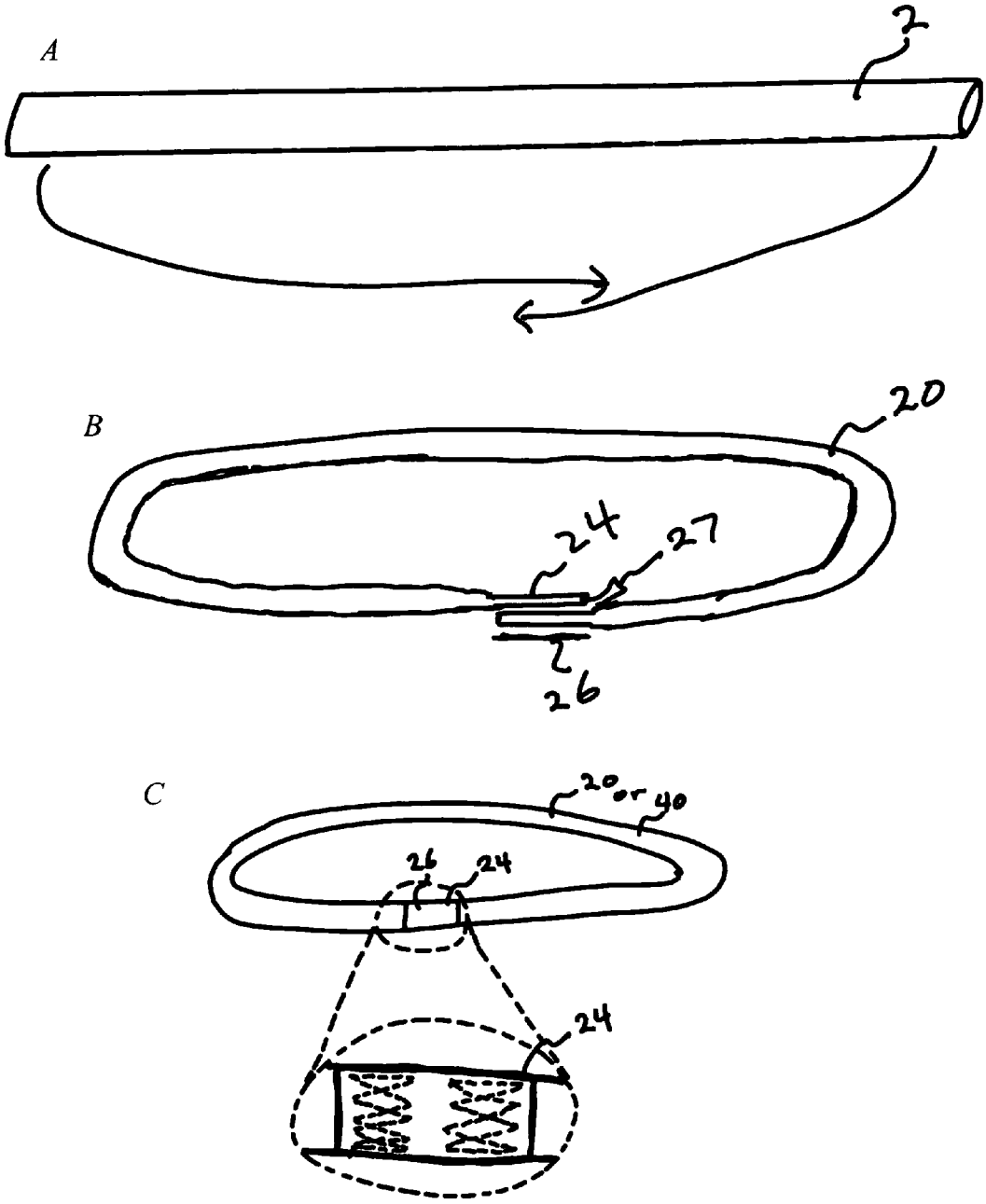
Figure 3:
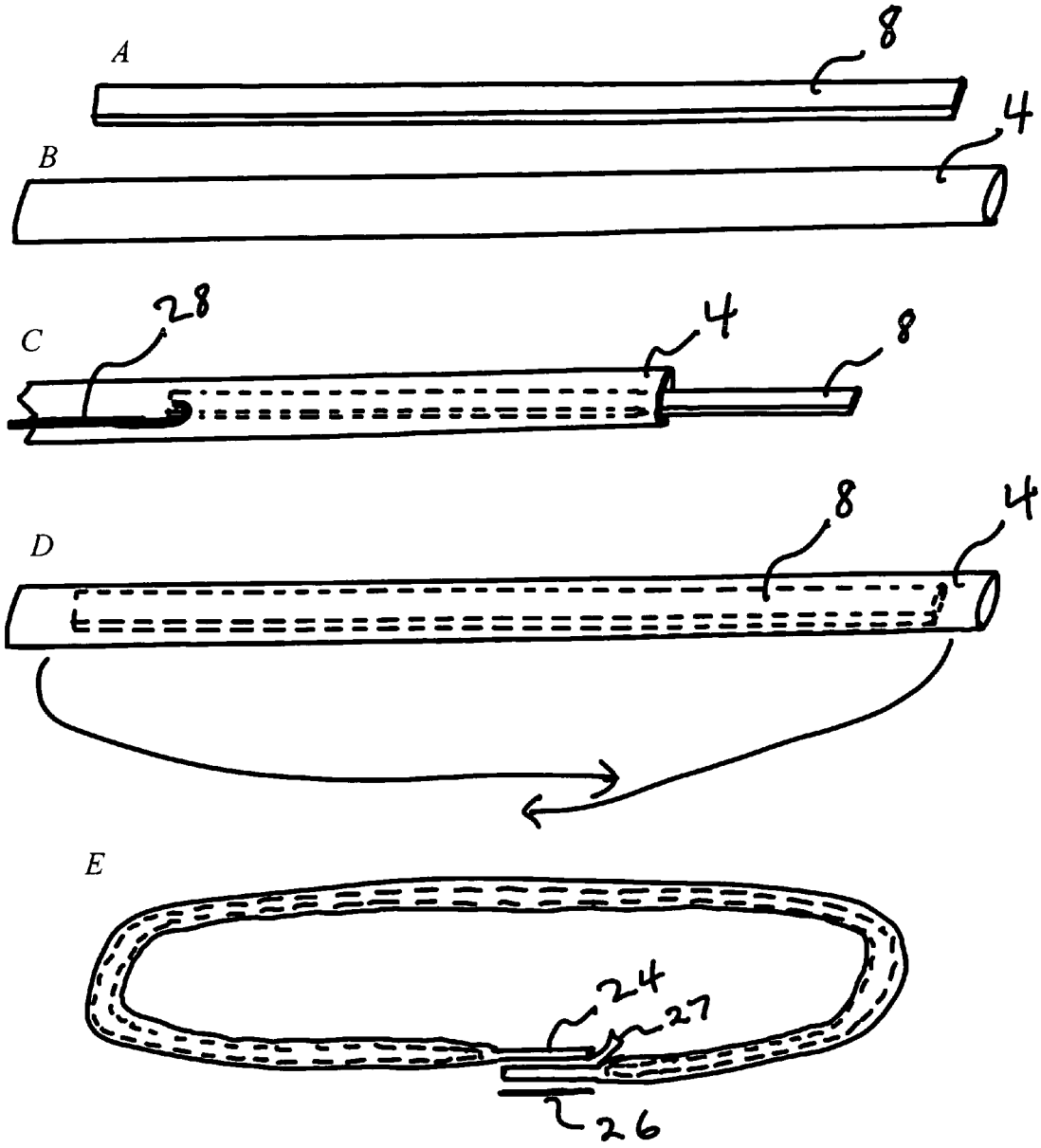

Heather Boerner, 'Branching Out', Yoga Journal Magazine, May 2008 pp. 129-130, Yoga Journal, San Francisco, California, USA.

Martina Steinbach, Top Trend, SHAPE Magazine, German edition, Jun. 2008, p. 4, SHAPE Magazine, Munich, Germany. Unknown, TreeYoga, Fit for Fun Magazine, Jul. 2008, p. 95-96 Fit for Fun, Frankfurt, Germany.

Lesley Tellez, TreeYoga Quick Newspaper, Sep. 8, 2008, p. 16, Dallas Morning News, Dallas, Texas, USA.

A. Lubowski, Connecting with Nature through TreeYoga, Health & Fitness Website, Sep. 7, 2008.

Roni Proter, A North Texas Man Invents the Yoga Swing, Channel 33 KDAF TV News, Jul. 14, 2009.

Heather Boerner, Branching Out—An Innovative Yogi Challenges Our Relationship to Gravity, On-line Yoga Journal Magazine, reference: http://www.yogajournal.com/lifestyle/2717.

Christine Lepisto, Tree Yoga for a New Relationship with the Environment, treehugger, Berlin, On-line reference: http://www.treehugger.com/files/2008/08/tree-yoga.php.

* cited by examiner

*A*

*B*

*A*

*B*

*A*

*B*

*A*

*B*

METHOD AND APPARATUS FOR PRACTICING YOGA IN AND AROUND TREES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

The field of this invention relates to a method and a portable apparatus for practicing Yoga outdoors, specifically, practicing Yoga using the apparatus attached to a strong tree. Class 482 Exercise Devices 2. Background It is a well-established fact that proper exercise is a component of good health. Tens-of-thousands of games, toys, recreational activities, and exercising devices have been created to enhance the pleasure and even overcome the pain of exercising. Not only does the present invention method and apparatus offer an extremely effective, efficient, and motivating way to enhance physical conditioning, but it also addresses several other key aspects of a healthy and enjoyable life style, namely: balance, strength, flexibility, and a connection with nature. The strong trend in the United States toward improved mental and physical health through Eastern exercise practices like Yoga have positively impacted our society's holistic approach to health.

Over the past few decades, our modern society has transitioned from an active, outdoor society to a sedentary, indoor society. We spend an ever increasing percentage of our daily lives indoors: attending school, working in office environments, working on computers, watching television, and playing video games. We have even transitioned many of our normal outside activities such as walking, running, or biking to indoor activities such as running on a treadmill or riding a stationary exercise bicycle. Many group classes like aerobics, Pilates, and Yoga are conducted indoors in gyms and in Pilates and Yoga studios.

When people experience what our parents referred to as "cabin fever" they suffer from an increase in anxiety and mild depression, but it seems like we have exchanged the simple solution of 'going outside' with taking ever increasing amounts of 'anti-anxiety and antidepressant' medications. Not only are we not spending time outdoors, we are losing our connection with the natural world of trees, flowers, clouds, wildlife, rain, and wind. We have substituted our personal experience in nature with a vicarious experience about nature through TV programs such as The Discovery Channel or Animal Planet. The problem has become so prevalent that it now has been given a name: 'nature deficit disorder'. This disorder has serious implications and is characterized with many symptoms ranging from childhood obesity, teenage depression, and lethargic adults. It is the intention of the current invention's method and apparatus to help mitigate some of these negative symptoms by encouraging, and providing a means for, enjoyable, meaningful, and playful outdoor stretching and exercising activities.

Richard Louv, author of *Last Child in the Woods—Saving our Children from Nature-Deficit Disorder* shares with us on page 34 and 35:

> Nature-Deficit Disorder describes the human costs of alienation from nature, among them: diminished use of the senses, attention difficulties, and higher rates of physical and emotional illnesses. The disorder can be detected in individuals, families, and communities. Nature deficit can even change human behavior in cities, which could ultimately affect their design, since long-standing studies show a relationship between the absence, or inaccessibility, of parks and open space with high crime rates, depression, and other urban maladies. Nature Deficit Disorder can be recognized and reversed, individually and culturally. But deficit is only one side of the coin. The other is natural abundance. By weighing the consequences of the disorder, we also can become more aware of how blessed our children can be—biologically, cognitively, and spiritually—through positive physical connection to nature.
>
> Indeed, the new research focuses not so much on what is lost when nature fades, but on what is gained in the presence of the natural world.

There have been many people throughout history that have eloquently stated the intense need for this connection between mankind and nature—the following are a few examples:

John Burroughs, Naturalist & Essayist said: "I go to nature to be soothed and healed, and to have my senses put in order."

E. M. Forester, Novelist & Humanitarian asks: "What is the good of your stars and trees, your sunrise and the wind, if they do not enter into our daily lives?"

Walt Whitman, Poet, wrote: "Why are there trees I never walk under but large and melodious thoughts descend upon me?"

Robert Louis Stevenson, Novelist & Poet, shares: "It is not so much for its beauty that the forest makes a claim upon men's hearts, as for that subtle something, that quality of air, that emanation from old trees, that so wonderfully changes and renews a weary spirit."

John Muir, Naturalist & Writer, said: "Everybody needs beauty as well as bread, places to play in and pray in, where nature may heal and give strength to body and soul."

John Muir also wrote: "I only went out for a walk and finally concluded to stay out until sundown, for going out, I found, was really going in."

Henry David Thoreau wrote: "Nature is but another name for health"

Saint Bernard, Theologian, announced: "You will find something more in woods than in books. Trees and stones will teach you that which you can never learn from masters."

The National Science Foundation (NSF) Grant #0216560 funded the following cited work. The NSF is an independent federal agency created by Congress in 1950 "to promote the progress of science; to advance the national health, prosperity, and welfare; to secure the national defense . . . ." With an annual budget of about $6.06 billion (statistic from NSF website updated June, 2008), the NSF is the funding source for approximately 20 percent of all federally supported basic research conducted by America's colleges and universities.

The following are excerpts of National Science Foundation (NSF) Grant #0216560: Evidence for a fundamental and pervasive shift away from nature-based recreation "Is love of nature in the US becoming love of electronic media?"

16-year downtrend in national park visits explained by watching movies, playing video games, interne use, and oil prices. By: Oliver R. W. Pergams and Patricia A. Zaradic Department of Biological Sciences (MC 066),
University of Illinois at Chicago, 845 W. Taylor St., Chicago, Ill. 60607, USA
Stroud Water Research Center, 970 Spencer Road, Avondale, Pa. 19311, USA Edited by Gretchen C. Daily, Stanford University, Stanford, Calif., and approved Dec. 17, 2007 (received for review Oct. 17, 2007)

Abstract

After 50 years of steady increase, per capita visits to U.S. National Parks have declined since 1987. To evaluate whether we are seeing a fundamental shift away from people's interest in nature, we tested . . . four classes of nature participation variables:

(i) visitation to various types of public lands in the U.S. and National Parks in Japan and Spain,
(ii) number of various types of U.S. game licenses issued,
(iii) indicators of time spent camping, and
(iv) indicators of time spent backpacking or hiking.

The four variables with the greatest per capita participation were visits to Japanese National Parks, U.S. State Parks, U.S. National Parks, and U.S. National Forests, with an average individual participating 0.74-2.75 times per year.

The longest and most complete time series tested suggest that typical declines in per capita nature recreation began between 1981 and 1991, are proceeding at rates of −1.0% to −1.3% per year, and total to date −18% to −25%.

In conclusion, all major lines of evidence point to an ongoing and fundamental shift away from nature-based recreation.

In the book: 'Healing Gardens: Therapeutic Benefits and Design Recommendations' (Wiley, 1999) by Clare Cooper Marcus and Marni Barnes pages 1 and 2 states:

Over the centuries, the connection between healing and nature was gradually superseded by increasingly technical approaches—surgery, medicines, drugs, and X-rays. A separation occurred between attention to body and spirit, and increasingly, different parts of the body (eyes, heart, digestive tract, etc.) and different afflictions (cancer, arthritis, etc.) were treated by specialists. The idea that access to nature could assist in healing was all but lost.

Research exists to support the notion of nature as healer. Studies have been conducted that confirm the clearly positive benefits to patients, staff, and visitors of hospital outdoor space. Specifically designated "healing gardens" have begun to appear in hospitals. Certain relatively new categories of medical settings that specialize in the care (rather than cure) of their patients—for example, the hospice and facilities for Alzheimer's patients—have enthusiastically embraced the importance of a garden along with a homelike interior. Books have appeared that urge readers to consider their own gardens as a healing or sanctuary space (Minter, 1993; McDowell and Clark-McDowell, 1998; Jay, 1998). The organization that accredits 85 percent of U.S. acute care hospitals now requires that for certain patient groups (pediatrics, long-term care) and those experiencing long stays, the hospital provide access to the outdoors through appropriate use of hospital grounds, nearby parks and playgrounds, and adjacent countryside. (The Center for Health Design, 1998)

Clearly, ancient knowledge about the restorative power of nature is not completely lost. The time is ripe to present what we currently know from research and what we can learn from best practice in landscape design to promote the reintegration of nature and the healing process.

Background for Addressing the Need and Developing a Solution:

Yoga is an incredible way to exercise and has withstood the test of time—it has literally been practiced continuously for thousands of years. Many Eastern Yoga masters and instructors conduct Yoga outdoors; however, as Yoga made its way to the Western cultures, for the most part, it has been moved indoors and has lost some of its inherent value. I was introduced to this invaluable form of exercise through an indoor Yoga studio. I later started conducting some of my Yoga sessions outdoors during my daily run with my dogs.

The idea of doing Yoga 'with a tree' was born in my experience. Early one morning, facing the sun as it broke over the horizon; I was doing my Yoga breathing and stretching exercises near the East entrance of the University of Texas, Dallas campus. Captivated by the peaceful experience of this ancient form of exercise, I became acutely aware of the beauty of the nearby Live Oak Trees.

I had spent much of my early childhood climbing and swinging from trees and in tree houses that my father had built for us. Since my recently deceased father had fostered in us a love and appreciation for trees by planting literally tens-of-thousands of trees, the idea of continuing my Yoga exercises from up in the tree had no longer crossed my mind, than I found myself taking my next breath from up among the branches.

Joining the tree in this early morning praise was an experience that was natural, enchanting, exciting, and calming—all at the same time. The thought of adding some form of 'Tarzan rope' for stabilization was the next logical step.

This idea materialized into the recently, world-wide flourishing—TreeYoga Multi-Sling (TYMS). Numerous experienced Yoga instructors readily and curiously embraced performing Yoga in a tree using this multiple sling apparatus. Yogis (men) and Yoginis (women) alike have helped transform this idea of doing TreeYoga into a reality, enriching their Yoga experience together in nature, both in and around the trees.

My experiences while serving as a U.S. Marine Reconnaissance Officer, as well as my training with Army Airborne and Ranger Units, Navy Seals, and Navy Underwater Demolition Teams, caused me to work with numerous forms of parachuting, mountain climbing, and rappelling harnesses and webbing. These experiences also caused me to have a life-long commitment to remaining in top physical condition through hiking, cycling, marathon running, and now Yoga in trees. This incredible, ancient method of exercising combined with this renewed connection with nature has helped me develop significantly in areas of: balance, strength, and flexibility.

Class 482 Exercise Devices: 482/91; 482/95; 482/96; 482/143

Field of Search: 482/91; 482/95; 482/96; 482/126; 482/131; 482/142; 482/143; 482/144; 910

PRIOR ART

There are numerous portable devices for exercising and stretching that have some of the characteristics of the present invention.

U.S. Pat. No. 5,984,845 to Powers (1999) 'Body Stretching Apparatus' discloses a portable body stretching apparatus utilizing straps and handles to facilitate effective stretching, but lacks the ability to attach to a tree to enable stretching and exercising of abdominal muscles or facilitating cardio-vascular conditioning.

U.S. Pat. No. 6,368,255 to Chan-Rouse (2002) 'Device for Stretching and Yoga' is made of inelastic straps with multiple loops attached permanently to a single longer strap can facilitate an individual's Yoga routine of deep stretching, but is limited in scope to an individual only using their own limbs to offer resistance to exercising and stretching, but lacks the ability to support the whole body in certain advantageous positions such as suspended inversions.

U.S. Pat. No. 5,624,359 to Dean (1997) 'Apparatus for Stretching Muscles' comprises a series of loops each permanently joined to the adjacent loop to form a large circle of loops. This device is effective to support isometric stretching to a degree, however the narrow nature of the loops and lack of padding would place a concentration of force at the point of contact with the body thus causing pain, which is counter productive to effective stretching. It also lacks the ability to support the whole body.

U.S. Pat. No. 864,188 to Patterson (1907) 'Exercising Apparatus' provides a means to elongate the spine from suspension overhead, but is limited to being attached to a doorframe and provides no means to exercise the lower body. Although elongating the spine gently has some health benefits, this device is very limited in functionality to support a full exercise program.

U.S. Pat. No. 5,921,903 to Lawrence (1999) 'Abdominal Exercise Device' is limited to supporting the exercise of sit-ups on the ground or a horizontal support, which can often cause pain in the tailbone area for many people.

U.S. Pat. No. 3,752,474 to Macabet (1973) 'Arm and Leg Push Pull Type Exercising Device' provides a means for a full body workout, but lacks the ability to support a users weight and is not suitable for supporting inversions.

Special Benefit for Special Needs Individuals:

Terminally Ill

Patients that must endure long visits in hospitals with terminal or chronic illnesses can enjoy the restorative power and energy that come from connecting with nature, by "hanging out" and practicing Yoga safely in trees outside the hospital or in a nearby park. This not only improves ones physical conditioning and sense of well-being, but also provides an incredible boost to ones mental, emotional, and spiritual state. This natural, outdoor environment also facilitates meaningful conversations and relationships between patients and health care professionals that sometimes do not occur in a clinical environment.

Physically and Mentally Handicapped

Individuals with special needs require assistance to initiate, evaluate, and develop modified physical exercise programs. Numerous organized and individual exercise activities and methods are not suitable, and are often discouraging, for many individuals with special needs. The Yoga multi-sling, is not only reconfigurable to a plethora of configurations to support and challenge most any physically abnormal or handicapped person, it also provides a motivating and encouraging method for one to exercise in a natural environment using a tree as their live stretching and exercising partner. Depending on the handicapping condition of the individual, the Yoga multi-sling can support someone to exercise independently, or if they needed supervision or assistance, it provides a fun and relaxing environment and a possible 'change of pace' from the normal indoor routine. The Yoga multi-sling can be reconfigured to provide a secure padded harness for the legs and hips of a physically challenged individual; and subsequently attached to a ratchet hoist and a non-padded sling attached to a strong overhead tree branch. This can be manipulated to lift the person out of the wheelchair into a supported, but liberating, exercising posture.

Aging Senior Citizens

People are living longer and longer as our medical community becomes better and better at overcoming many illnesses and previously fatal diseases with medications and transplants. However, the types of exercises and physical fitness activities that are adaptable to older individuals are fairly narrow. The Yoga multi-sling can support older individuals that may have trouble keeping their balance as they stand to do normal exercises. Older people that are restricted to wheelchairs can use the Yoga multi-sling to increase the full range of motion of their shoulders and arms as well as perform strength building isometric exercises. Sometimes, people restricted to wheelchairs become discouraged about their lack of mobility and ability to engage in meaningful exercises. Having someone attach a sling to a low hanging overhead branch of a tree, can provide both a motivating and challenging means to perform isometric and dynamic cardiovascular enhancing and muscle strengthening and stretching exercises.

Recovering War Veterans

Assisting soldiers returning from combat that need physical, mental, and emotional rehabilitation can be overwhelming. Of course, no exercise kit is going to mend the possible deep physical and emotional scars left on men and women serving their country in a combat role. However, the Yoga multi-sling can provide a recovering war veteran a means with which to participate in meaningful and refreshing exercises. It can be adapted to overcome the exercising challenges resulting from a plurality of physical injuries, including missing or severely injured limbs. Many times injured combatants returning from war are extremely depressed about their future and need some hopeful path towards the road to recovery. Using the Yoga multi-sling in nearby tree can provide that path and relieve frustration in an 'out of hospital environment' through rigorous outdoor exercise.

Physical Therapy Patients

Exercising daily plays a crucial role in the process of healing and recovering from various injuries or diseases. One of the greatest obstacles for physical therapists in treating their patients is getting them to actually perform the prescribed exercises. Providing an enjoyable and meaningful way to independently perform the prescribed exercises using the multi-sling and a tree, without having to go to a hospital or physical therapy clinic, can significantly enhance the value of the therapists to their patients. Balance, joint control, and muscle re-training are other types of important physical therapy exercises that can be facilitated with the Yoga multi-sling apparatus. Also, individuals with limited mobility such as amputees can enjoy exhilarating cardiovascular workouts during their initial stages of recovery, even before they transition to using prosthetics.

Photosynthesis

Another very interesting and valuable aspect of doing Yoga in close proximity to trees is the benefit of the tree supplying fresh oxygen to the individual during the workout through the process of photosynthesis. One does not need to evaluate the details of photosynthesis very deeply to appreciate the miraculous design by the Creator of the universe—the symbiotic relationship between mankind and trees.

Equation of Photosynthesis: $6\ CO_2 + 12\ H_2O \rightarrow C_6H_{12}O_6 + 6\ O_2 + 6\ H_2O$ Note that trees and plants take in carbon-dioxide and release oxygen, while people and animals breathe in oxygen and breathe out carbon-dioxide.

SUMMARY

The present invention method and apparatus offer an extremely effective, efficient, and motivating way to enhance physical conditioning. It addresses several key aspects of a healthy and enjoyable life style, namely: balance, strength, flexibility, and a connection with nature. Over the past few decades, our modern society has transitioned from an active, outdoor society to a sedentary, indoor society. We are losing our connection with the natural world of trees, flowers, clouds, wildlife, rain, and wind. We have substituted our personal experience in nature with a vicarious experience about nature, which has led to 'nature deficit disorder'. This disorder is characterized with symptoms ranging from childhood obesity, teenage depression, and lethargic adults. It is the intention of the current invention's method and apparatus to help mitigate some of these negative symptoms by encouraging enjoyable outdoor exercising activities.

John Burroughs, Naturalist & Essayist, said: "I go to nature to be soothed and healed, and to have my senses put in order."

As reported in the study funded by the National Science Foundation grant (Pergams and Zaradic, 2007), the 18-25% downtrend in national park visits since 1987 can be explained by the excessive watching of movies, playing video games, and using the interne. It is an indicator of poor health and a societal detachment from nature. Significant evidence points to an ongoing and fundamental shift away from nature-based recreation.

"Over the centuries, the connection between healing and nature has been gradually superceded by increasingly technical approaches—surgery, medicines, drugs, and X-rays. A separation has occurred between attention to body and spirit.

Clearly, ancient knowledge about the restorative power of nature is not completely lost. The time is ripe to promote the reintegration of nature and the healing process. Yoga is an incredible way to exercise and has withstood the test of time—it has literally been practiced continually for thousands of years. Joining a tree in early morning praise is natural, enchanting, exciting, and calming—all at the same time. The method and apparatus to facilitate practicing Yoga around trees in nature has materialized into the recently worldwide flourishing—TreeYoga Multi-Sling (TYMS). Numerous experienced Yoga instructors readily and curiously embrace performing Yoga in a tree using this multi-sling apparatus.

There are numerous portable devices for exercising and stretching that have some of the characteristics of the present invention, but they all lack the ability to easily attach to a tree in a safe and non-destructive manner.

DRAWINGS

FIGS. 1 through 13—Apparatus

FIGS. 14 through 25—Operation

FIG. 1: Materials for construction of various types of slings
FIG. 2: Materials and construction of non-padded sling
FIG. 3: Materials and construction of padded sling
FIG. 4: Materials and construction of long narrow Helper sling sewn with small loops on each end
FIG. 5: The Yoga multi-sling base unit—connecting the components
FIG. 6: Multi-sling configuration examples using three and four continuous loop slings
FIG. 7: Multi-sling configuration of four padded and two non-padded slings
FIG. 8: Non-padded slings connected in series
FIG. 9: Materials and construction of rip-stop Nylon sling
FIG. 10: Multi-sling configurations using non-padded, padded, and rip-stop Nylon slings
FIG. 11: Multi-sling configuration using non-padded, padded, and Helper slings
FIG. 12: Multi-sling configuration using non-padded, padded, rip-stop Nylon and Helper slings
FIG. 13: Drawstring backpack tote bag
FIG. 14: Attaching the Yoga multi-sling to a tree
FIG. 15: A progression of strengthening postures using First, Second, and Third Class Levers
FIG. 16: Terra Firma (on the ground) Postures
FIG. 17: Side of Trunk Postures
FIG. 18: Side of trunk posture with explanation of levers and forces
FIG. 19: Additional examples of side of trunk and Terra Firma postures
FIG. 20: Inverted Postures
FIG. 21: Terra Firma and Inverted Side of trunk postures
FIG. 22: Suspended Strengthening posture
FIG. 23: Up in tree posture using Yoga multi-sling as safety harness and stretching aid
FIG. 24: Using the Yoga multi-sling as a rappelling type harness
FIG. 25: Using the Yoga multi-sling from a wheelchair

DRAWINGS

Reference Numerals

2 Nylon tube webbing, current preferred embodiment—blue, 2-inch width
4 Nylon tube webbing, current preferred embodiment—red, 2-inch width
6 Nylon tube webbing, current preferred embodiment—1 inch width
8 Flat padding, current preferred embodiment—Neoprene rubber ¼ inch thick
10 Terra Firma postures
12 Side of trunk postures
14 Inverted Postures
16 Up in tree postures
20 Non-padded continuous loop sling
22 Resulting interlocking connection of continuous loops
23 Self-tightening noose for attachment to branch or tree trunk
24 Sewn overlap with zigzag sew pattern forming structurally sound connection
25 Sewn overlap with box style sew pattern
26 Woven label, 3 inch
27 Warning label, 1 inch
28 Pole with hook for pulling flat padding into tube webbing
40 Padded continuous loop sling
50 Fulcrum
51 Load
52 Effort
53 First Class Lever
54 Second Class Lever
55 Third Class Lever
60 Long narrow Helper sling sewn with small loops on each end
61 End loop on long, narrow Helper sling
62 Structural fabric, current preferred embodiment, rip-stop Nylon
64 Rip-stop Nylon continuous loop sling
70 Drawstring backpack tote bag
75 Yoga Multi-Sling base unit
90 Tree trunk
92 Strong branch
99 Prior Art

DETAILED DESCRIPTION

First Embodiment—FIGS. 1 through 13

FIG. 1: Materials for Construction of Various Types of Slings

FIG. 1A: Nylon tube webbing, current preferred embodiment—Mountain Climbing Spec, blue, 2-inch width FIG. 1B: Nylon tube webbing, current preferred embodiment—Mountain Climbing Spec, red, 2-inch width FIG. 1C: Nylon tube webbing, current preferred embodiment—Mountain Climbing Spec, 1 inch width FIG. 1D: Flat padding, current preferred embodiment—Neoprene rubber ¼ inch thick FIG. 2: Materials and Construction of Non-Padded Sling The current preferred embodiment is constructed of soft and pliable blue colored Mountain Climbing Specification Nylon Tube Webbing, 2-inch width (2) with a rated tensile strength of 7,500 pounds. The nylon tube webbing (2) is cut to a predetermined length, current preferred embodiment is 99¼ inches, and formed into a continuous loop (20) and the ends sewn together on a 3¼ inch overlap (24), which results in a single loop (20) with a finished length of 48 inches (20). A 3 inch woven label (26) is sewn on the outside of the 3¼ inch overlap (24) and a 1 inch wide warning label (27) is sewn into the overlap (24) such that it protrudes approximately ¾ inch from underneath the overlap. Note: The thread used to attach the ends of the nylon webbing together is an industrial strength thread of the type used to sew industrial slings with two separate zigzag sew patterns (24) each rated for 5000 pounds, sewn with industrial grade sewing machines.

FIG. 2A: Webbing (2) to be formed into continuous loop

FIG. 2B: Webbing (2) formed into continuous loop non-padded sling (20) including warning label (27) sewn into the zigzag sew pattern within the overlap (24) and a 3 inch woven label (26) sewn on top of sewn overlap (24).

FIG. 2C: Zigzag sew pattern on overlap (24) on both non-padded (20) and padded (40) continuous loop slings FIG. 3: Materials and Construction of Padded Sling The current preferred embodiment is constructed of soft and pliable red colored Mountain Climbing Specification Nylon Tube Webbing 2-inch width (4) with a rated tensile strength of 7,500 pounds that has a non-absorbent neoprene rubber (8) (the same material of which wetsuits are made) inserted inside the entire length (minus the overlap (24)) of the nylon tube webbing (4). It includes a 3 inch woven label (26) and a 1 inch warning label (27), both sewn with a zigzag sew pattern into overlapping seam (24). The nylon tube webbing (4) is cut to a predetermined length—current preferred embodiment is 87¼ inches. The neoprene rubber (8) is 1½ inch wide, ¼ inch thick pad cut to a predetermined length—current preferred embodiment is 81 inches, is inserted inside of the nylon tube webbing (4) using a pole with a hook (28) such that the nylon webbing (4) completely encapsulates the neoprene pad (8) and runs the entire length of the nylon tube webbing (4) with the exception of the 3¼ inch overlap (24) on each end. The ends of the red nylon tube webbing (4) are sewn together with a 3¼ inch overlap (24), which results in a single loop (40) with a finished length of 42 inches. A 3 inch woven label (26) is sewn on the outside of the 3¼ inch overlap (24) and a 1 inch wide warning label (27) is sewn into the overlap (24) such that it protrudes approximately ¾ inch from underneath the overlap (24). Note: The thread used to attach the ends of the nylon webbing together is an industrial strength thread of the type used to sew industrial slings; with two separate zigzag sew patterns (24) each rated for 5000 pounds, sewn with industrial grade sewing machines.

FIG. 3A: Flat padding, current preferred embodiment—Neoprene rubber ¼ inch thick (8)

FIG. 3B: Nylon tube webbing, current preferred embodiment—red, 2-inch width (4)

FIG. 3C: Insertion of padding (8) into webbing (4)

FIG. 3D: Webbing (4) with inserted padding (8) to be formed into continuous loop FIG. 3E: Webbing (4) formed into continuous loop padded sling (40) including warning label (27) sewn into the zigzag sew pattern within the overlap (24) and a 3 inch woven label (26) sewn on top of sewn overlap (24).

Figure 4:
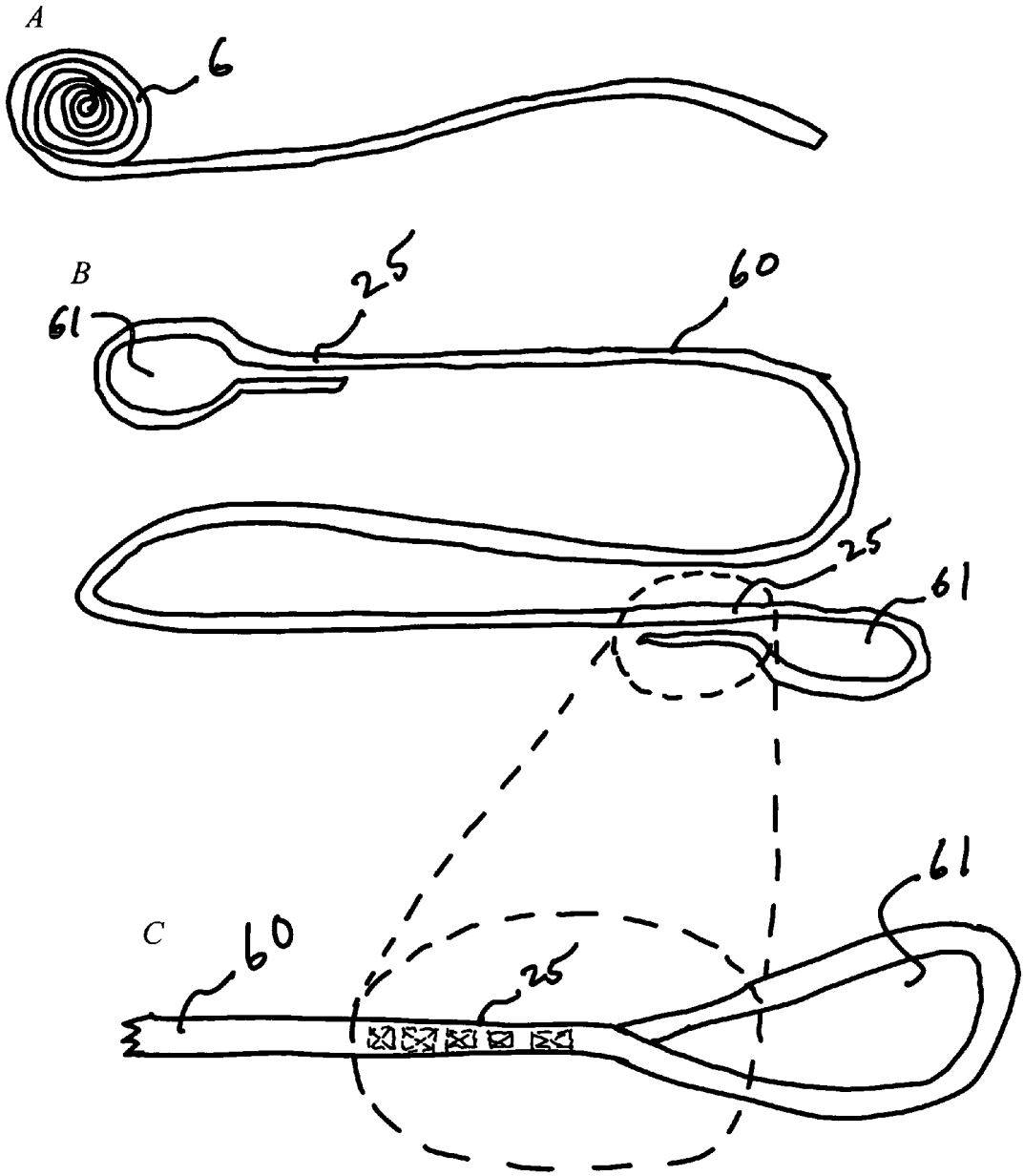

FIG. 4: Materials and Construction of Long Narrow Helper Sling Sewn with Small Loops on Each End The current preferred embodiment is constructed of soft, pliable colored Mountain Climbing Specification Nylon Tube Webbing 1 inch width (6) with a rated tensile strength of 3,500 pounds. This sling can be made to any length, but the current preferred embodiment is a finished overall length of 12 foot.

FIG. 4A: Nylon tube webbing, current preferred embodiment—1 inch width Mountain Climbing Spec webbing (6)

FIG. 4B: End loop on long, narrow Helper sling (60)

The current preferred embodiment, 1 inch wide nylon tube webbing (6) is cut to a predetermined length. The current preferred embodiment is 14 foot. Each end is doubled back onto itself for one foot, resulting in a flat closed loop (61).

FIG. 4C: This overlap is then sewn for 5 inches (25), resulting in the end loop of 7 inches (61), similar to a sewn handle on a dog leash. Note: The thread used to sew the end loops is an industrial strength thread of the type used to sew industrial slings; with 5 separate 'box type' sew patterns (25) side-by-side along the overlapped webbing, each rated for a minimum of 500 pounds, sewn with industrial grade sewing machines.

Figure 5:
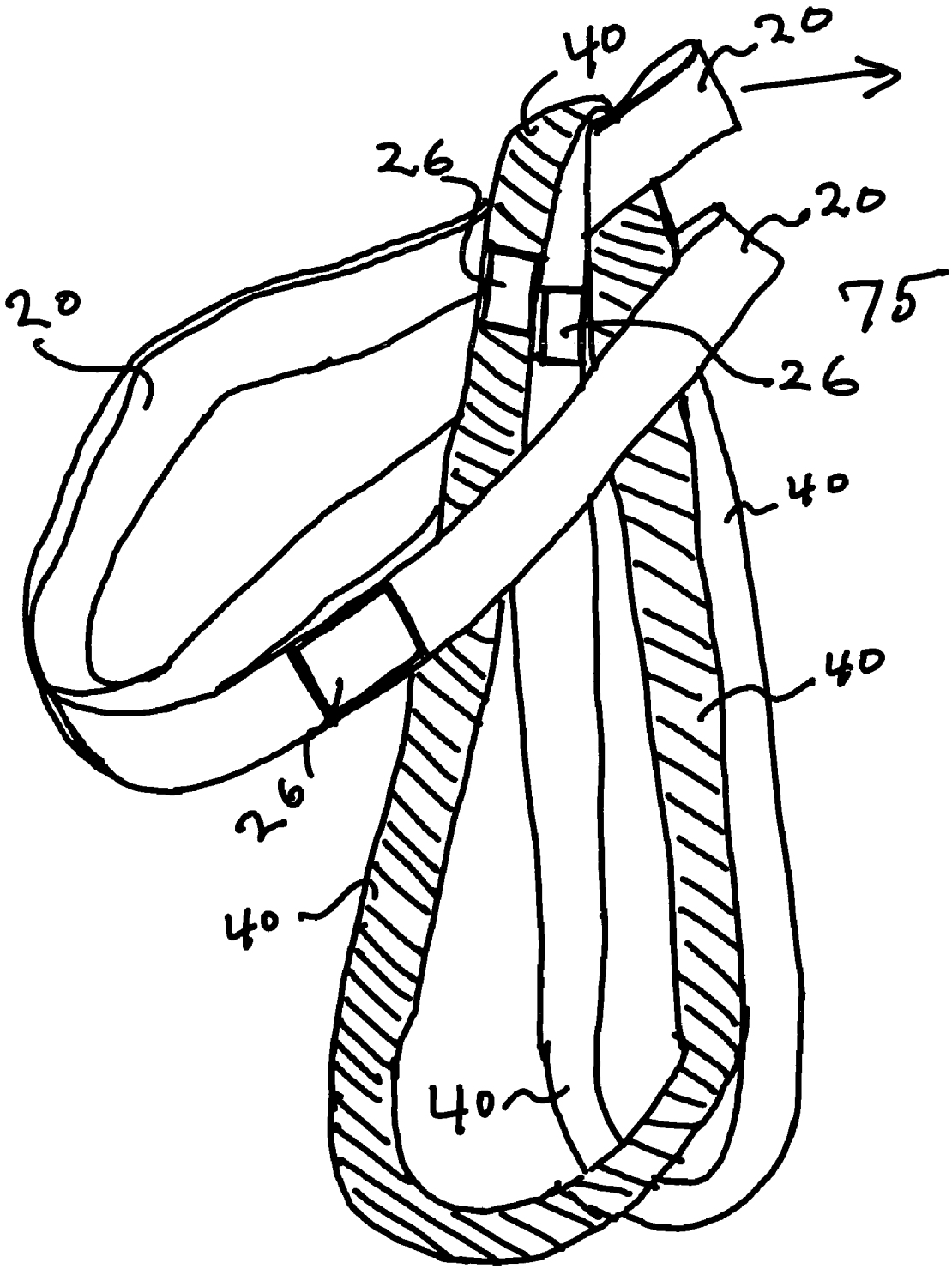

FIG. 5: Connecting the Components of the Yoga Multi-Sling Base Unit

The Yoga multi-sling base unit comprises two padded continuous loop slings (40) and one non-padded continuous loop sling (20), attached to one another in an interlocking connection.

Position 2 padded slings (40), into concentric circles. Loop one end of the non-padded continuous loop sling (20) over one end of the two padded slings (40), taking the opposite end of the non-padded sling (20), inserting it through the concentric padded slings. Pull the end completely through to form a resulting interlocking connection.

Figure 6:
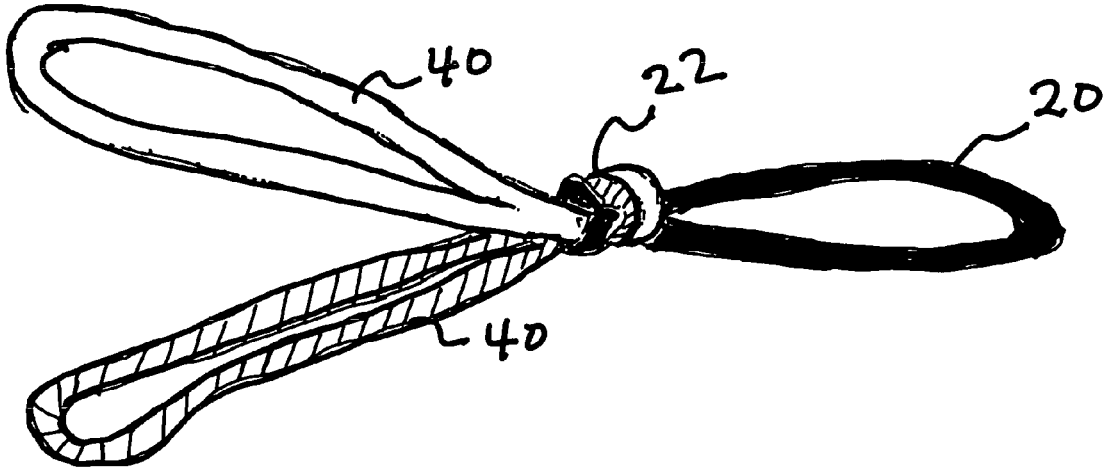
Figure 6:
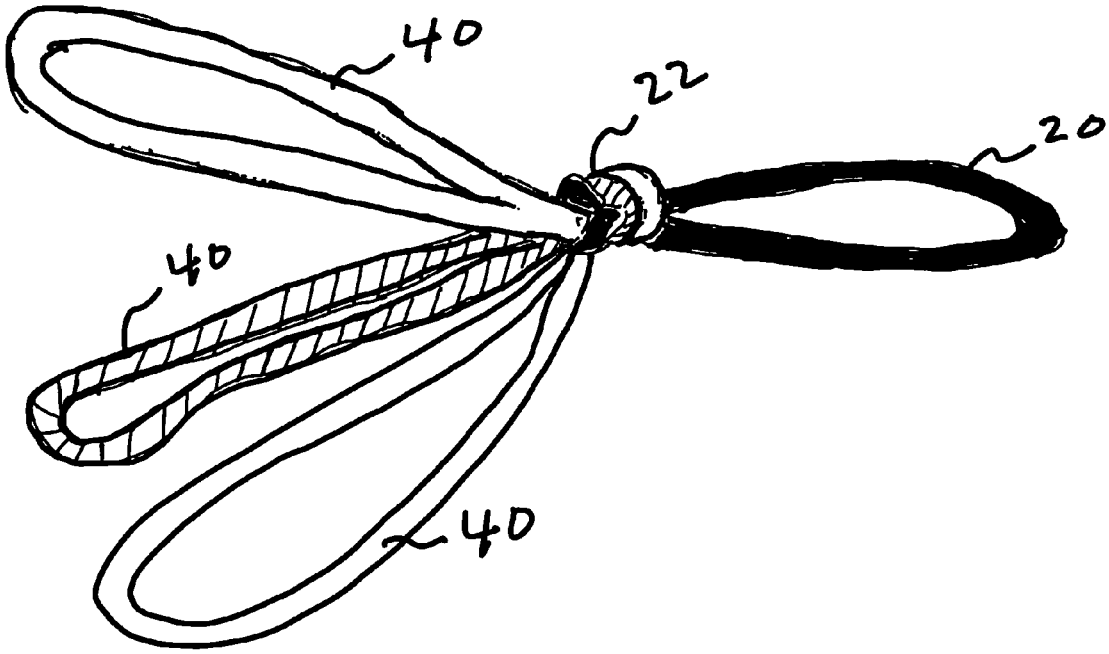

FIG. 6: Multi-Sling Configurations Using Three and Four Continuous Loop Slings Multiple slings can be attached together in a series or parallel fashion. This method of joining these slings together to form the multiple desired loop configurations to support specific types of exercises, demonstrates the extreme flexibility of this Yoga exercising apparatus.

FIG. 6A: Two padded (40) and one non-padded (20) continuous loop slings are attached to one another by looping one through the others and back through itself, in the resulting interlocking connection of continuous loops (22) in a 3 sling configuration.

FIG. 6B: Three padded (40) and one non-padded (20) continuous loop slings are attached to one another by looping one through the others and back through itself, in the resulting interlocking connection of continuous loops (22) in a 4 sling configuration.

Figure 7:
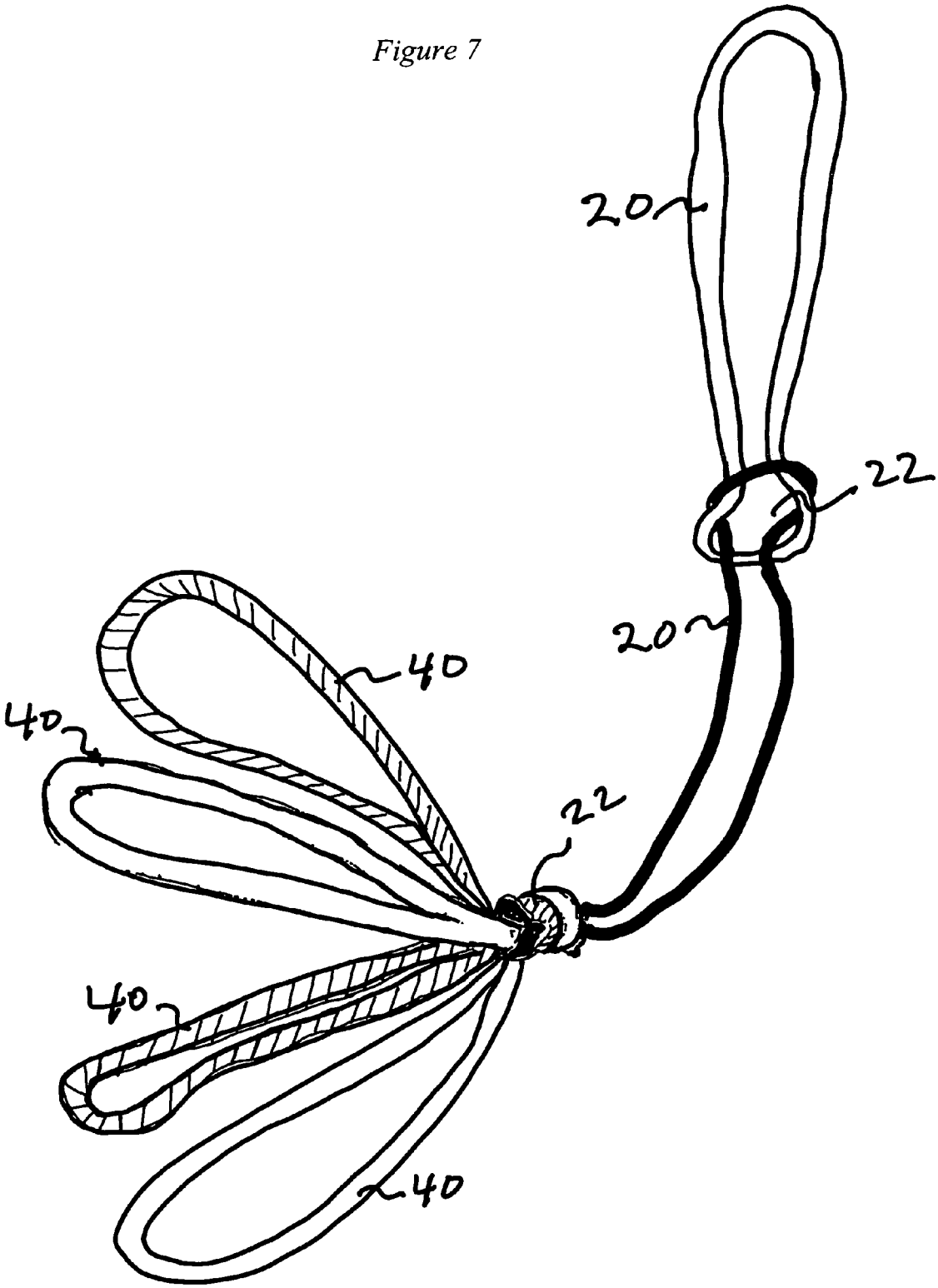

FIG. 7: Multi-Sling Configuration of Four Padded and Two Non-Padded Slings

Multiple padded slings (40) can be attached in the resulting interlocking connection of continuous loops (22) in a parallel fashion, to two non-padded slings (20) connected in series, in a resulting interlocking connection of continuous loops (22).

Figure 8:
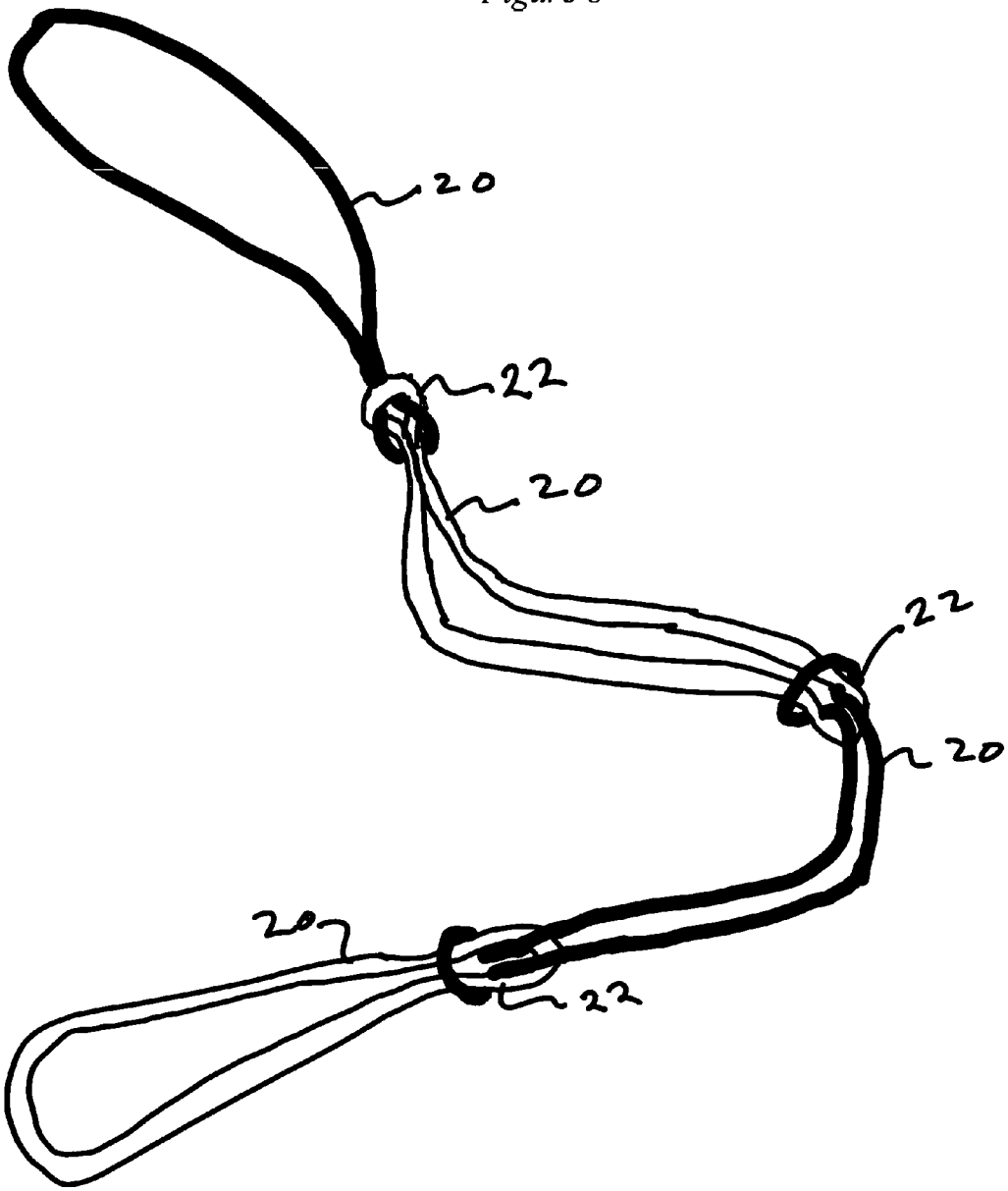

FIG. 8: Non-Padded Slings Connected in Series

Multiple non-padded slings (20) can be connected in series with resulting interlocking connections (22) to accommodate various tree trunk diameters and branch heights.

Figure 9:
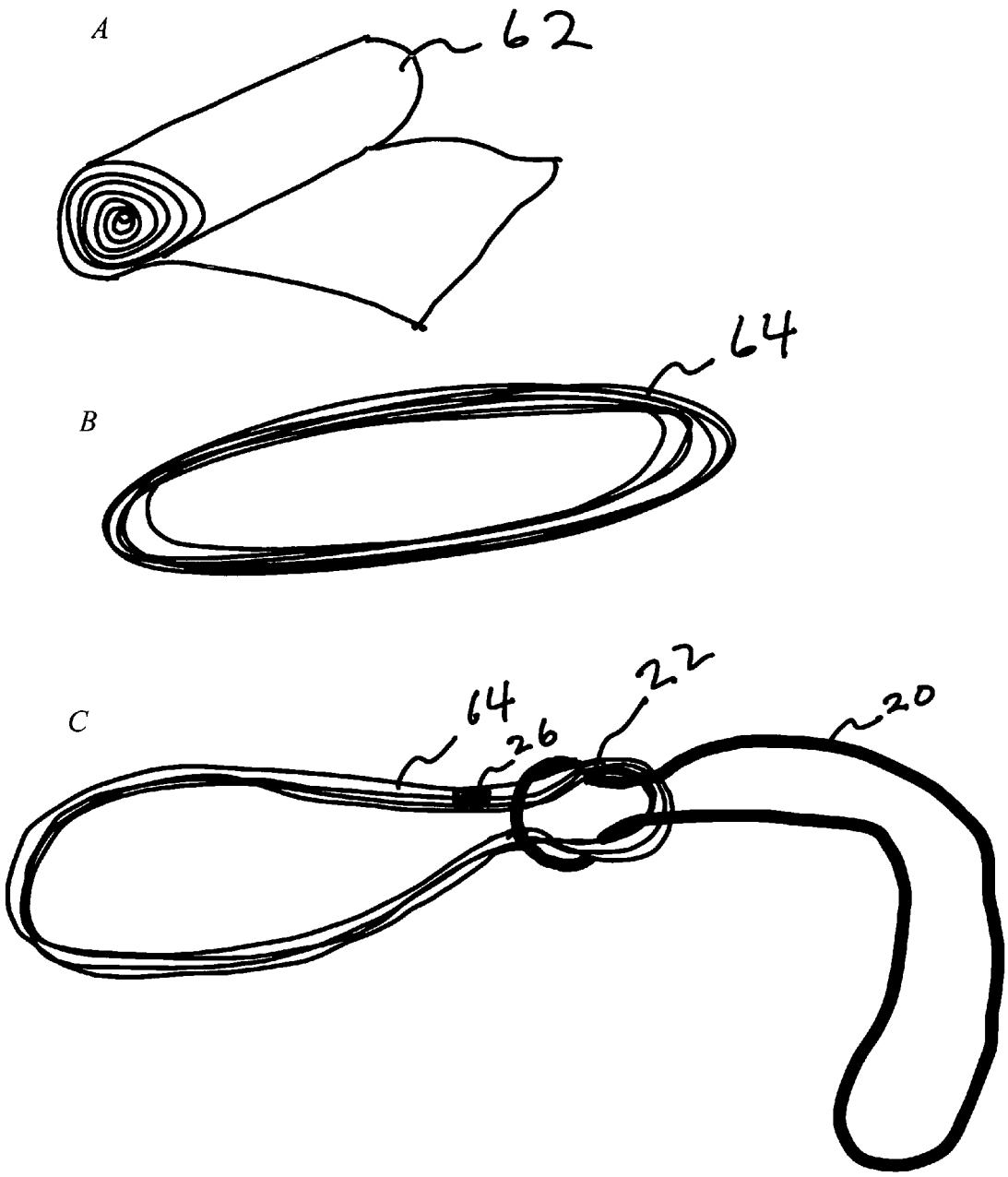
Figure 10:
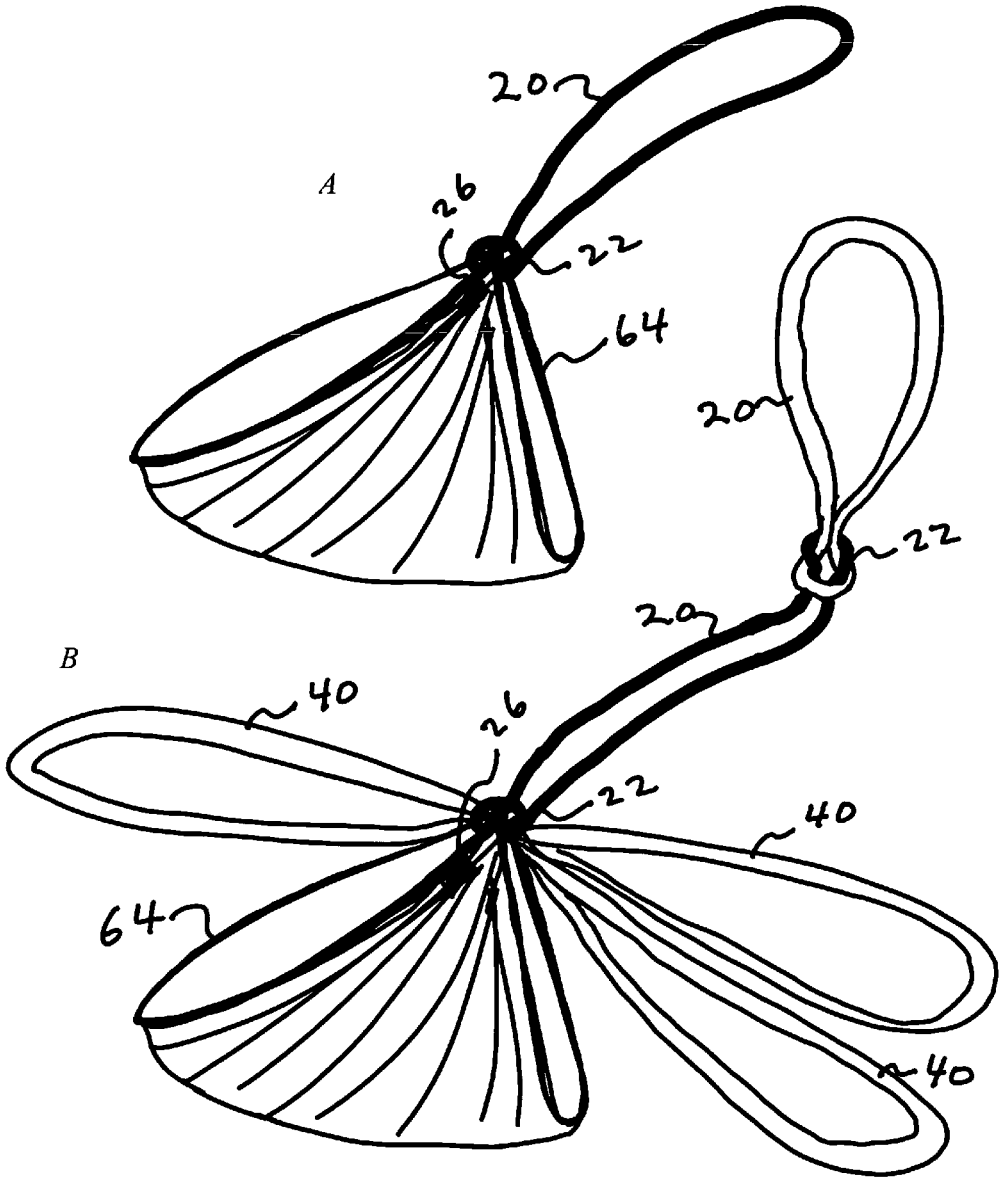

FIG. 9: Materials and Construction of Rip-Stop Nylon Sling

A large rectangular piece of structural fabric, current preferred embodiment of rip-stop nylon parachute type fabric (62) of a predetermined length that is sewn into a continuous loop (64) by joining the short ends of the rectangular fabric with sufficient overlap to hold a minimum of 500 pounds. This continuous loop rip-stop nylon sling can be attached to a non-padded sling (20) in the same fashion as described using the padded slings (40).

FIG. 9A: Structurally strong fabric (62), current preferred embodiment, rip-stop Nylon FIG. 9B: Structurally strong fabric sewn into continuous loop (64)

FIG. 9C: Rip-stop Nylon continuous loop sling (64) with woven label (26) attached in interlocking connection (22) with non-padded sling (20) in the same manner as the previously described configuration of the padded (40) and non-padded (20) slings FIG. 10: Multi-Sling Configurations Using Non-Padded (20), Padded (40), and Rip-Stop Nylon (64) Slings FIG. 10A: One non-padded sling (20) and one rip-stop Nylon sling (64) with woven label (26) and connected to one another in an interlocking connection (22)

FIG. 10B: Three padded slings (40) and one rip-stop Nylon sling (64) connected in parallel to two non-padded slings (20) connected in series forming corresponding interlocking connections (22)

Figure 11:
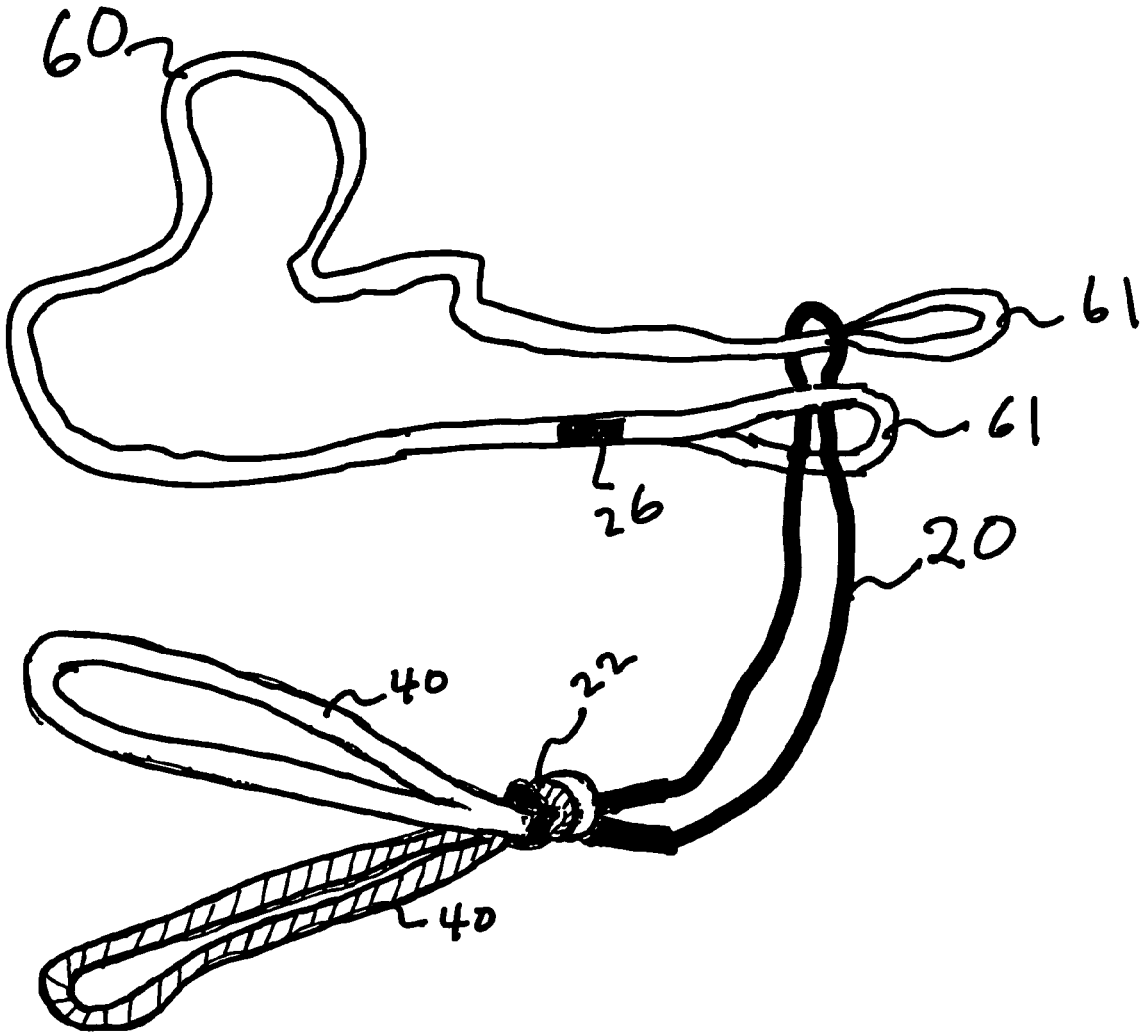

FIG. 11: Multi-Sling Configuration Using Non-Padded (20), Padded (40), and Helper (60) Slings Two padded slings (40) in parallel connected to one non-padded sling (20) forming corresponding interlocking connection (22) which is subsequently attached to one Helper sling (60) with woven label (26) by inserting the end of the non-padded sling (20) through one end loop (61), then threading the other end loop (61) through the protruding end of the non-padded sling (20).

Figure 12:
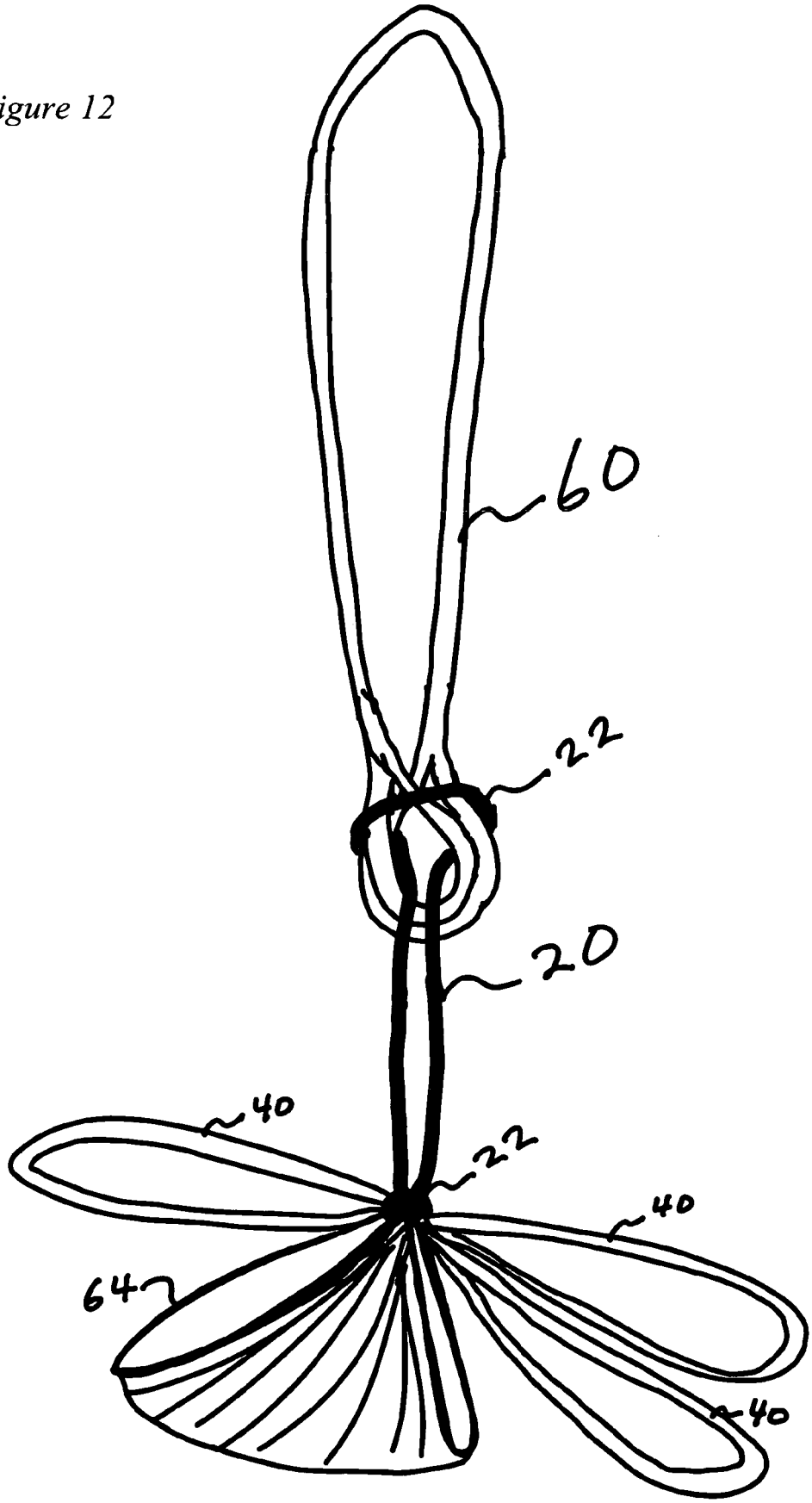

FIG. 12: Multi-Sling Configuration Using Non-Padded (20), Padded (40), Rip-Stop Nylon (64) and Helper (60) Slings Three padded slings (40) and one rip-stop Nylon sling (64) connected in parallel to one non-padded sling (20) forming corresponding interlocking connection (22) which is subsequently attached to one Helper sling (60) by inserting one end of the non-padded sling (20) through both end loops (61) of the Helper sling (60), then insert the resulting folded end of the Helper sling (60) through the protruding loop of the non-padded sling (20).

Figure 13:
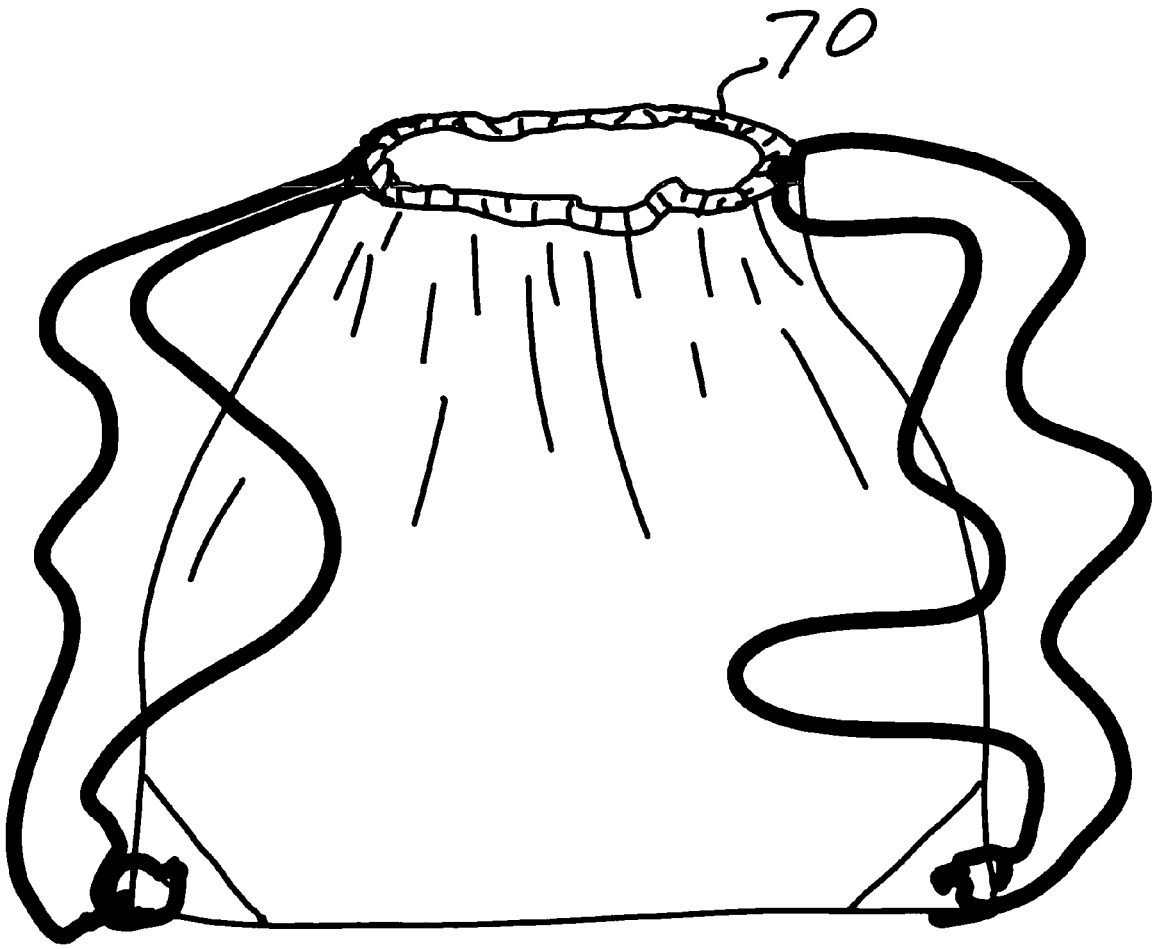

FIG. 13: Drawstring Backpack Tote Bag

Current preferred embodiment is a Nylon drawstring backpack tote bag for carrying the multi-slings

DETAILED DESCRIPTION

Operation: FIGS. 14-25

Figure 14:
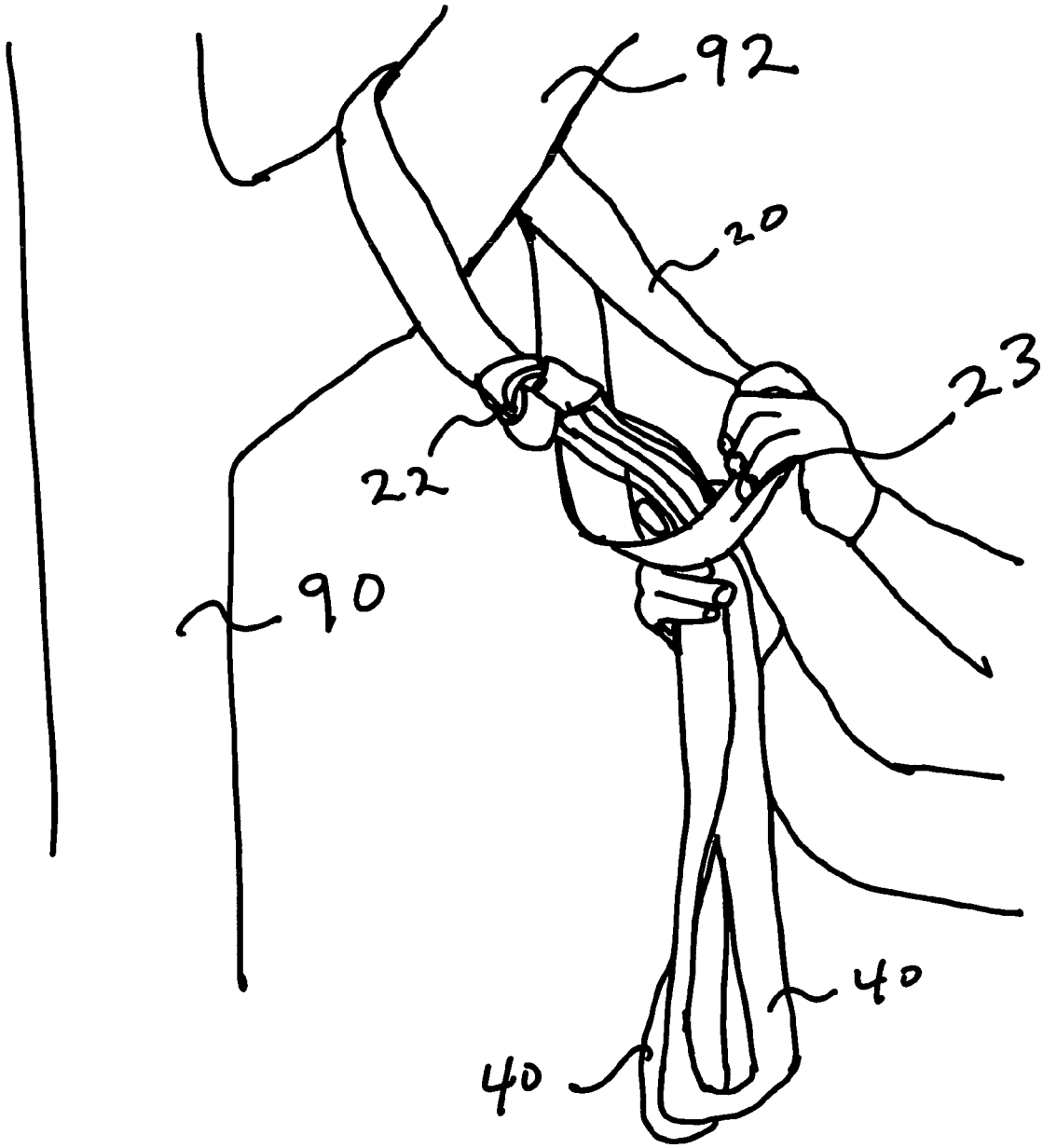

FIG. 14: Attaching the Yoga Multi-Sling to Tree

Shows a typical way to attach the Yoga multi-sling apparatus to a tree

Attach one or more non-padded slings (20) to a strong branch (92) or trunk (90) of a tree so that the non-padded sling (20) is looped around the strong branch (92) or trunk (92), then insert one or more padded slings (40) through the open loop of the non-padded sling (20) forming a self-tightening noose (23) around the branch (92) or tree trunk (90).

Figure 15:
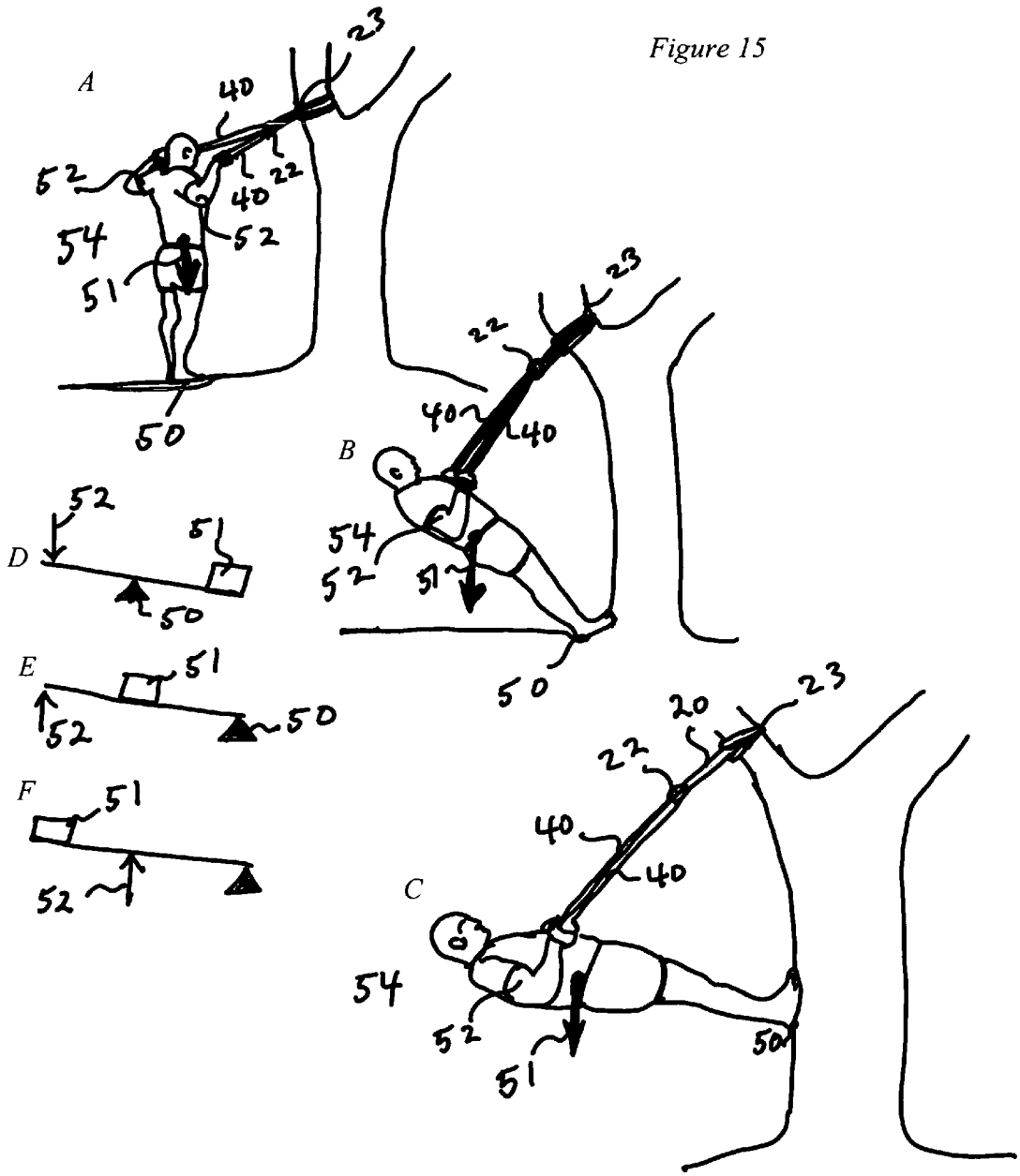

FIG. 15: A Progression of Strengthening Postures Using First, Second, and Third Class Levers This figure depicts a progression of strengthening postures for arms, shoulders, and back. First, the user faces the Yoga multi-sling attached to the tree and grasps the padded slings (40) by looping them around the back of the hand and then grasping them in each hand. Using the whole body as the exercising load (51), the user can lean away from the tree, FIG. 15A, forming a Second Class Lever (54), the feet against the ground as the Fulcrum (50), and the applied Effort (52) of the arms and shoulders. The load on the arms, shoulders, and back is increased by changing the relative position of the fulcrum by moving the feet towards the tree, FIG. 15B; and is further increased as shown in FIG. 15C, by moving the feet on the tree.

FIG. 15A: Easiest posture

FIG. 15B: More advanced posture

FIG. 15C: Most advanced posture

FIG. 15D: First Class Lever

FIG. 15E: Second Class Lever

FIG. 15F: Third Class Lever

Figure 16:
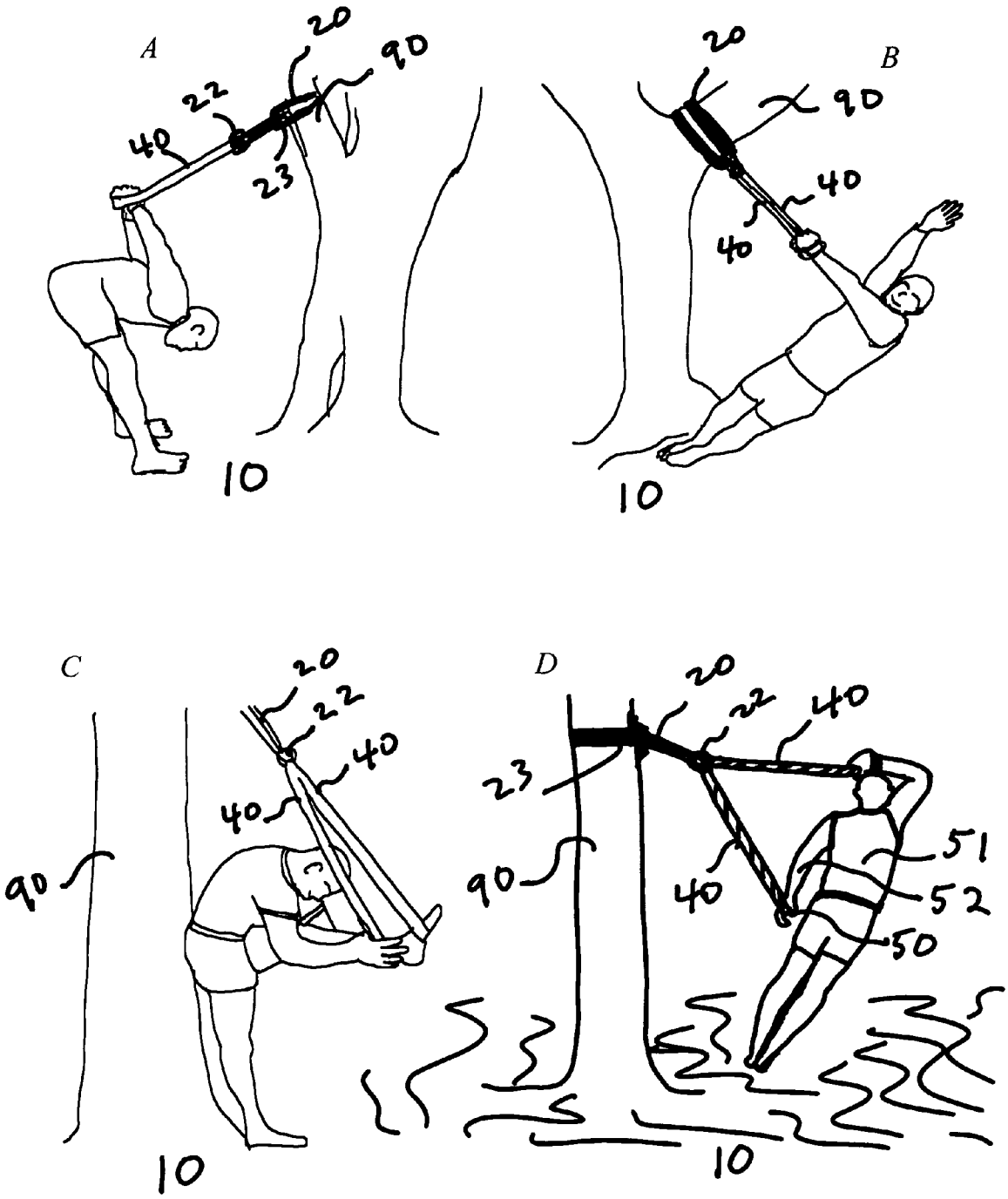

FIG. 16: Terra Firma (on the Ground) Postures

An endless number of Terra Firma postures, or postures performed from the ground, can be performed using the Yoga multi-sling (75) and a strong tree trunk (90) or branch (92) as a stretching partner. FIG. 16 depicts four such postures.

FIG. 16A: Shoulder, back, and leg stretching and strengthening

FIG. 16B: Shoulder, arm, and abdomen strengthening

FIG. 16C: Standing forehead to knee

FIG. 16D: Shoulder and arm stretching and strengthening

Figure 17:
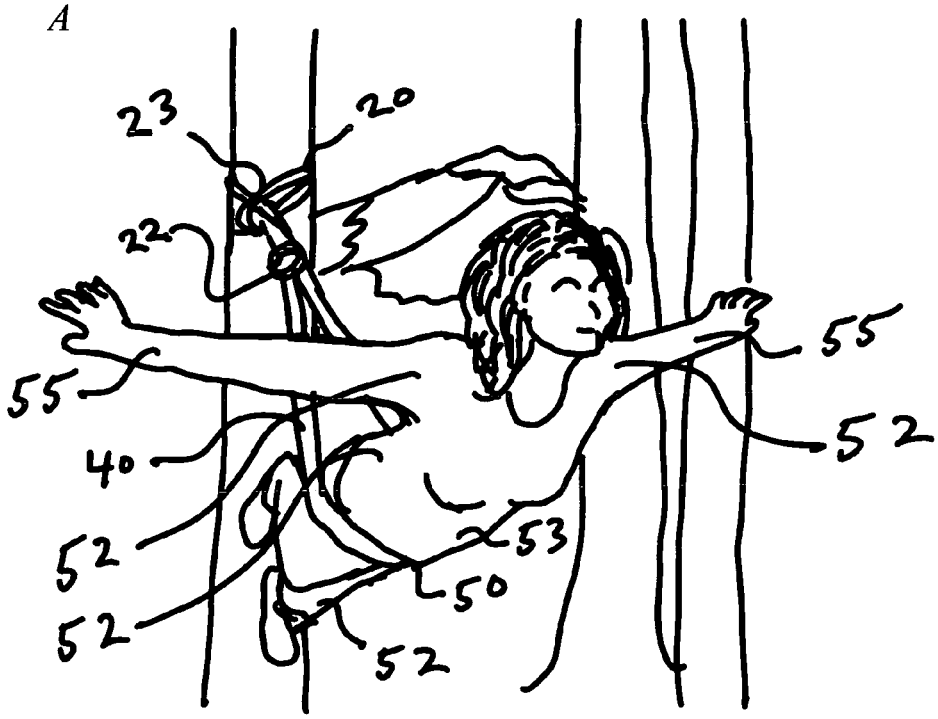
Figure 17:
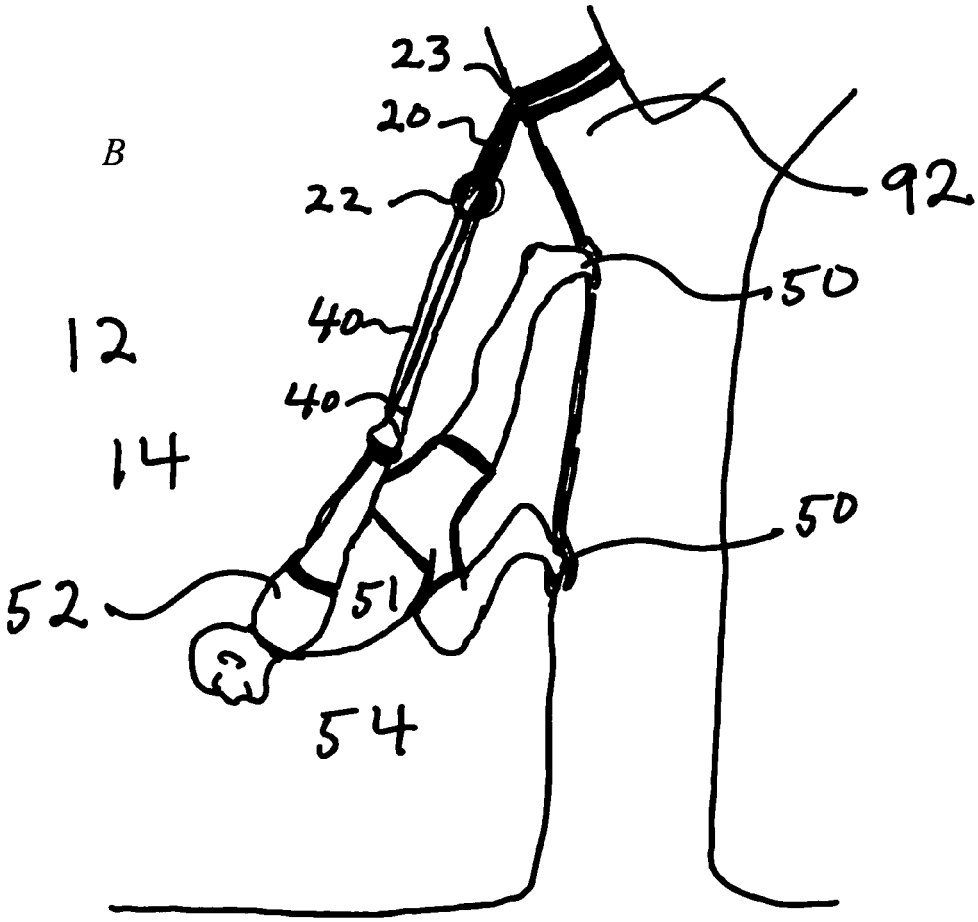

FIG. 17: Side of Trunk Postures

FIG. 17A: Non-padded sling (20) is attached to a tree in a self-tightening noose (23) around the trunk (90) of a tree. The padded slings (40) comfortably support the user across the front of the hips, forming a fulcrum (50) using the whole body as a First Class Lever (53). Holding the arms out to the side employs gravity as the exercising load forming Third Class Levers (55).

FIG. 17B: Depicts an inverted (14), side of trunk (12) posture that employs the body, the tree branch (92), and the padded sling (40) connected (22) to a non-padded sling (20) in a self-tightening noose (23) forming a Second Class Lever (54).

Figure 18:
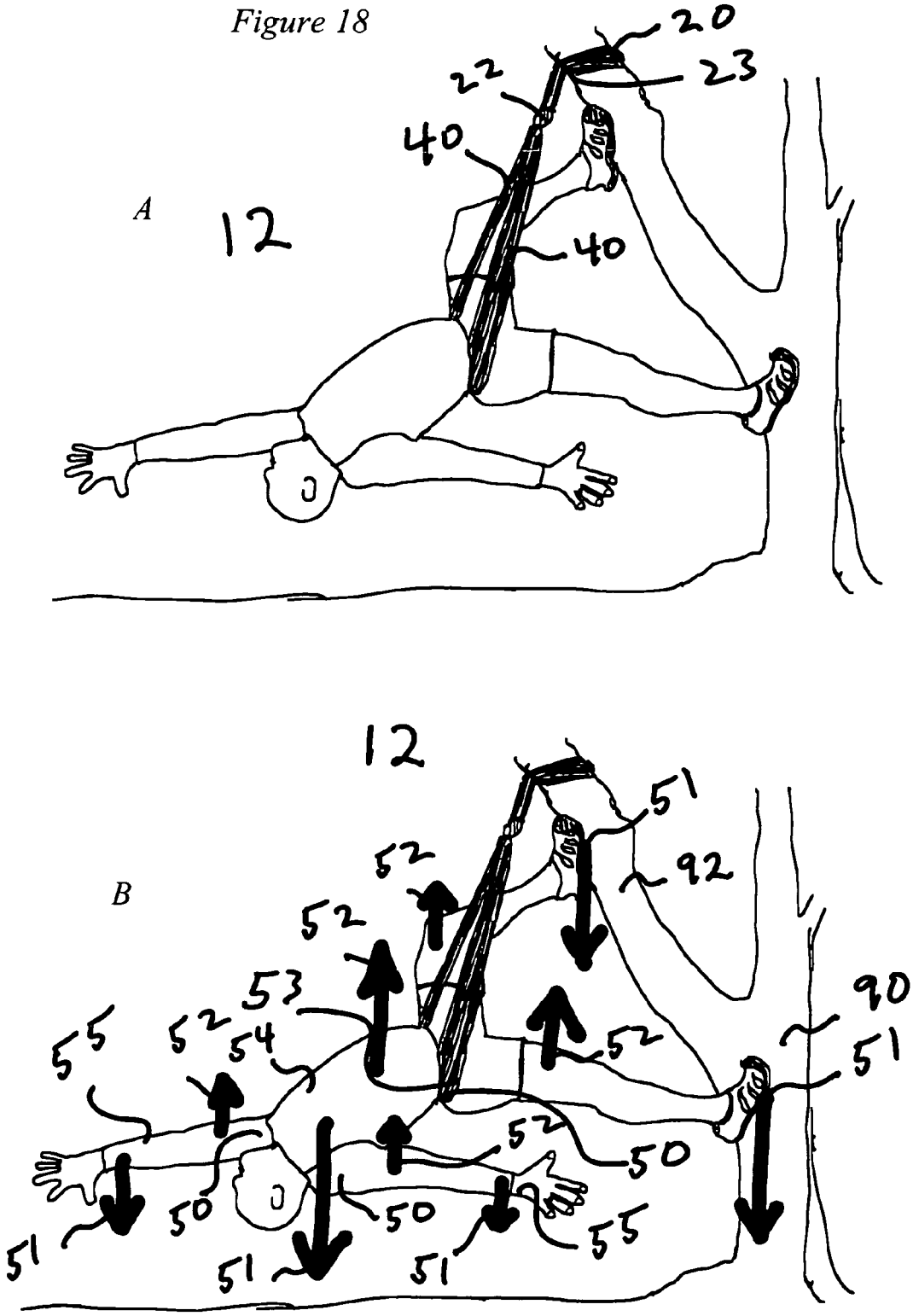

FIG. 18: Side of Trunk Posture with Explanation of Levers and Forces

FIG. 18A: Depicts a side of trunk (12) posture that employs the body, the tree branch (92), and the padded sling (40) connected (22) to a non-padded sling (20) in a self-tightening noose (23).

FIG. 18B: Depicts the numerous First Class Levers (53), Second Class Levers (54), and Third Class Levers (55), the related fulcrums (50), exercising loads (51), and exercising efforts (52) that are possible when using the Yoga multi-sling (75), the tree branch (92), the trunk (90), and the altered relationships to gravity.

Figure 19:
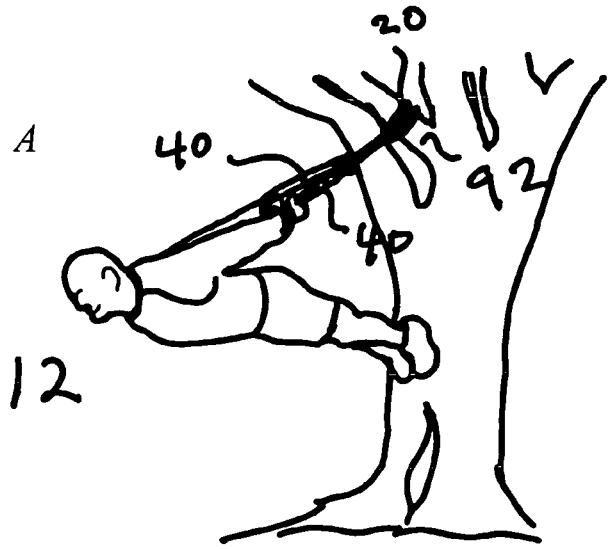
Figure 19:
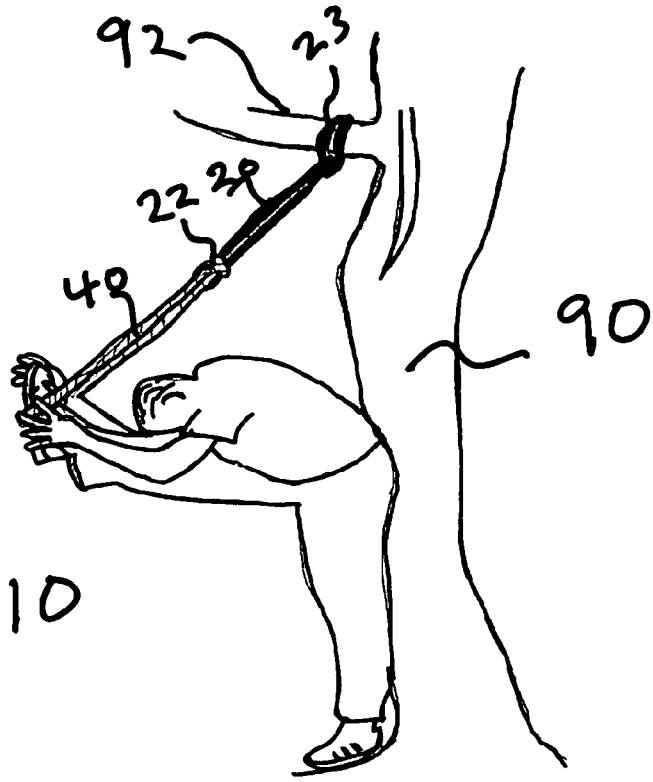

FIG. 19: Additional Examples of Side of Trunk and Terra Firma Postures

FIG. 19A: Depicts a face down, side of trunk (12) posture that employs the body, the tree branch (92), and the padded sling (40) connected to a non-padded sling (20) in a self-tightening noose.

FIG. 19B: Depicts a Terra Firma (10) posture that supports the foot and leg of the user, and is also stabilized by leaning against the tree trunk (90). The padded sling (40) is connected (22) to a non-padded sling (20) in a self-tightening noose (23) around the tree branch (92).

Figure 20:
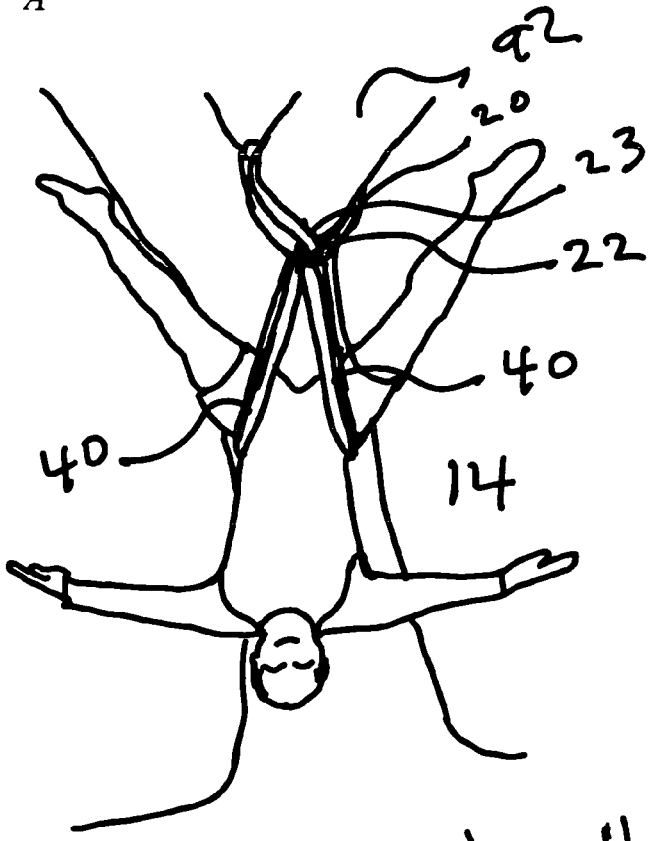
Figure 20:
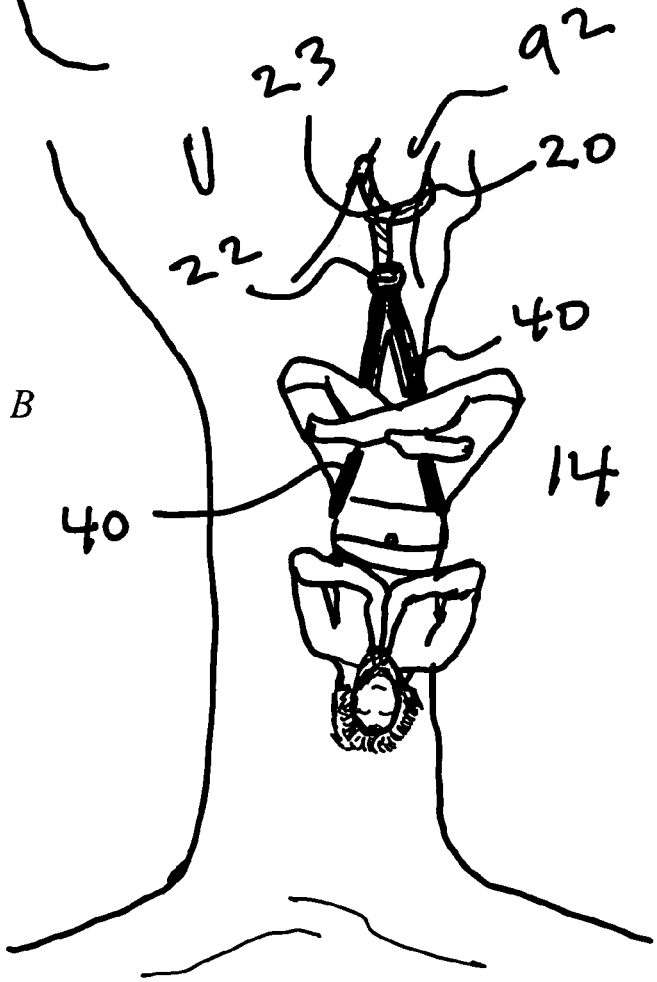

FIG. 20: Inverted Postures

FIG. 20A: Depicts an open legged, open armed inverted (14) posture that employs the body, the tree branch (92), and the padded sling (40) connected (22) to a non-padded sling (20) in a self-tightening noose (23).

FIG. 20B: Depicts a folded leg, hands in prayer, inverted (14) posture that employs the body, the tree branch (92), and the padded sling (40) connected (22) to a non-padded sling (20) in a self-tightening noose (23).

Figure 21:
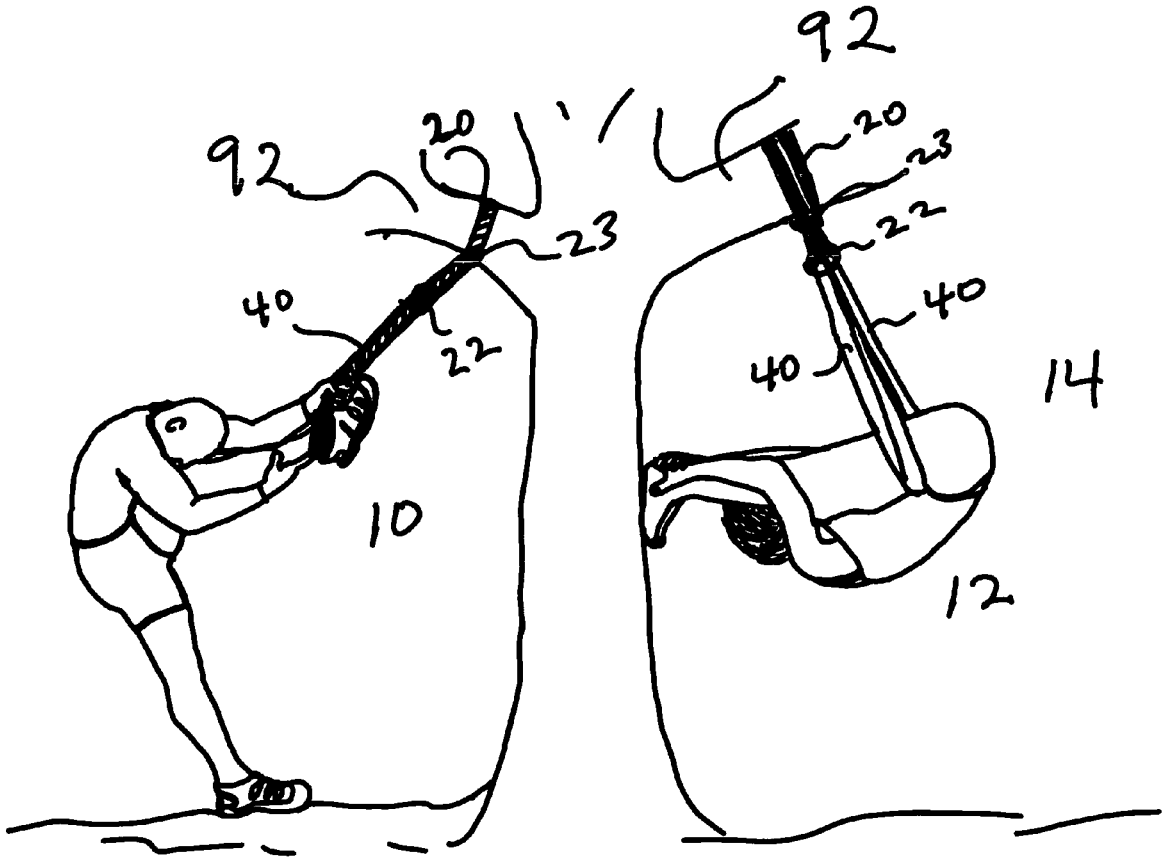

FIG. 21: Terra Firma and Inverted Side of Trunk Postures

Depicts both a Terra Firma (10) and an inverted (14), side of trunk (12) posture that employs the body, the tree branch (92), and the padded sling (40) connected (22) to a non-padded sling (20) in a self-tightening noose (23).

Figure 22:
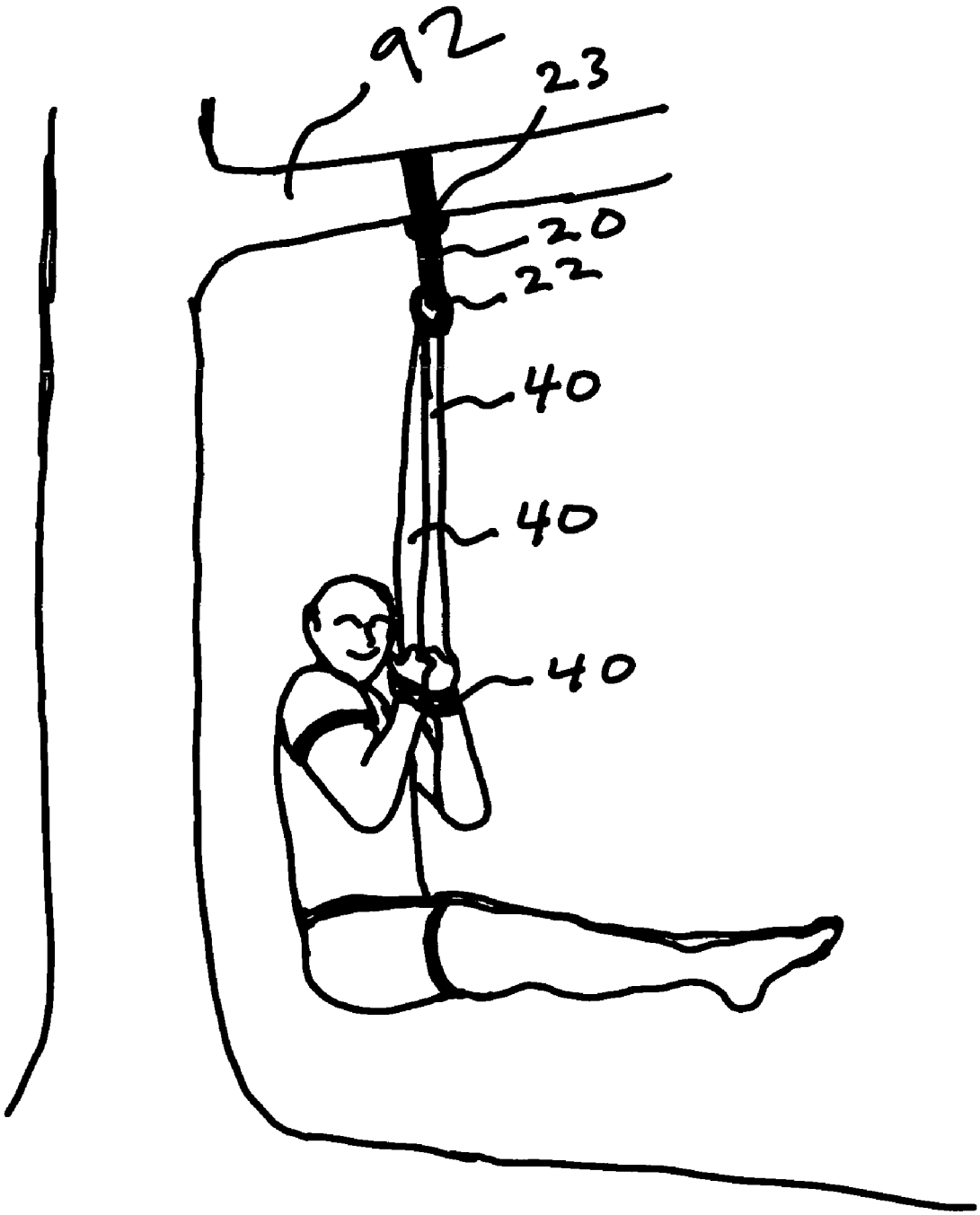

FIG. 22: Suspended Strengthening Posture

Depicts an advanced suspended, strengthening posture that employs the body, the tree branch (92), and the padded sling (40) connected (22) to a non-padded sling (20) in a self-tightening noose (23).

Figure 23:
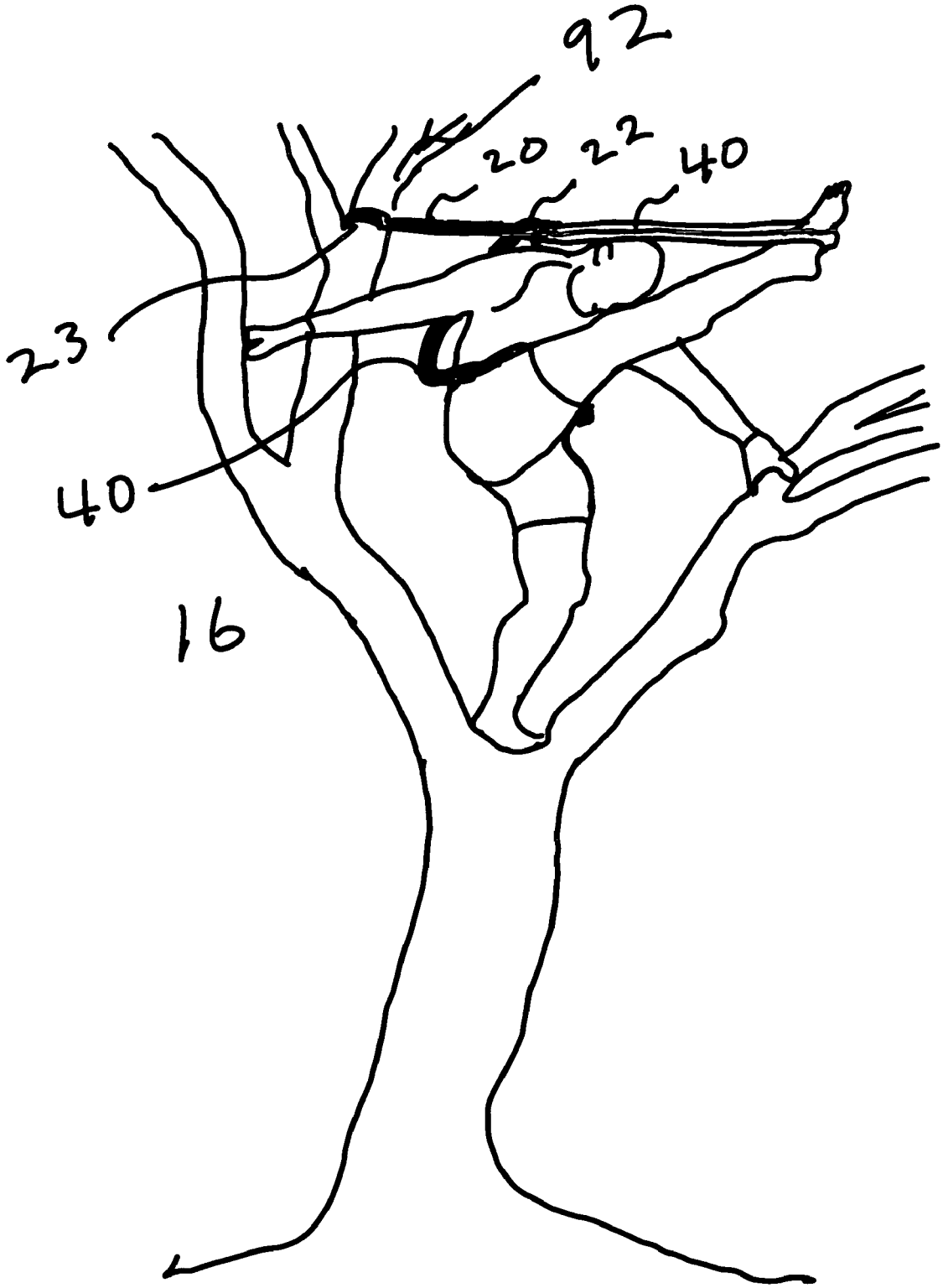

FIG. 23: Up in Tree Posture Using Yoga Multi-Sling as Safety Harness and Stretching Aid Depicts an advanced up in tree (16), stretching and strengthening posture that employs the body, the tree branch (92), and one padded sling (40) around the body as a safety harness and a second padded sling (40) supporting the foot and leg of the user. Both padded slings (40) are connected (22) to a non-padded sling (20) in a self-tightening noose (23) to a strong tree branch (92).

Figure 24:
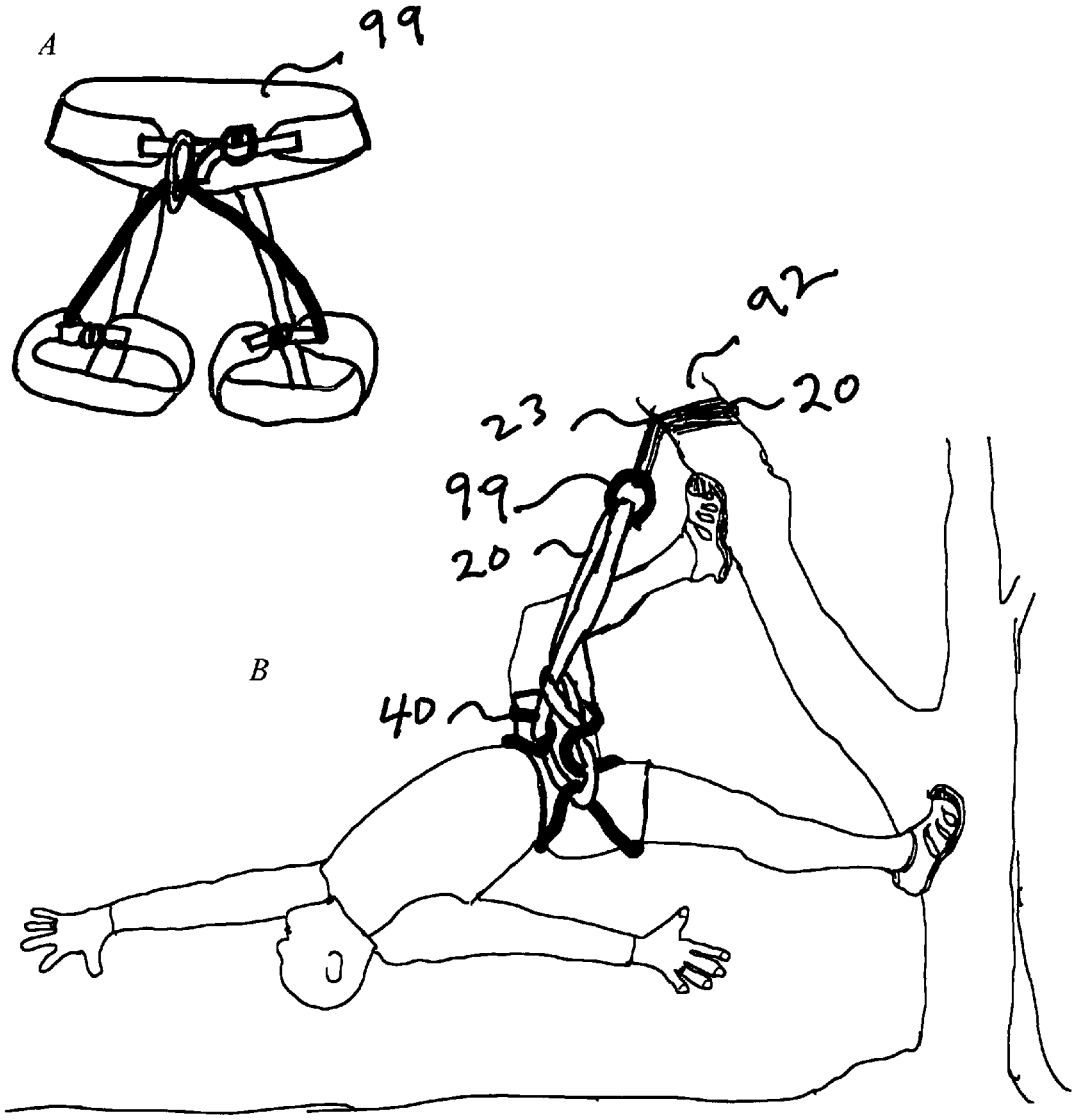

FIG. 24: Using the Yoga Multi-Sling as a Rappelling Type Harness

FIG. 24A: Prior Art—commercially available rappelling harness

FIG. 24B: Shows the resulting configuration of padded (40) and non-padded (20) slings made into a rappelling type harness. The padded sling (40) is wrapped around the lower back and back of each leg, pulled to front of waist, and then connected with non-padded sling (20) by looping non-padded sling (20) through each of the three formed loops of the padded sling (40). The non-padded sling (20) is then looped back through itself. It is then connected by a rappelling snap link (99) to a second non-padded (20) sling which had been previously attached to a strong branch (92).

Figure 25:
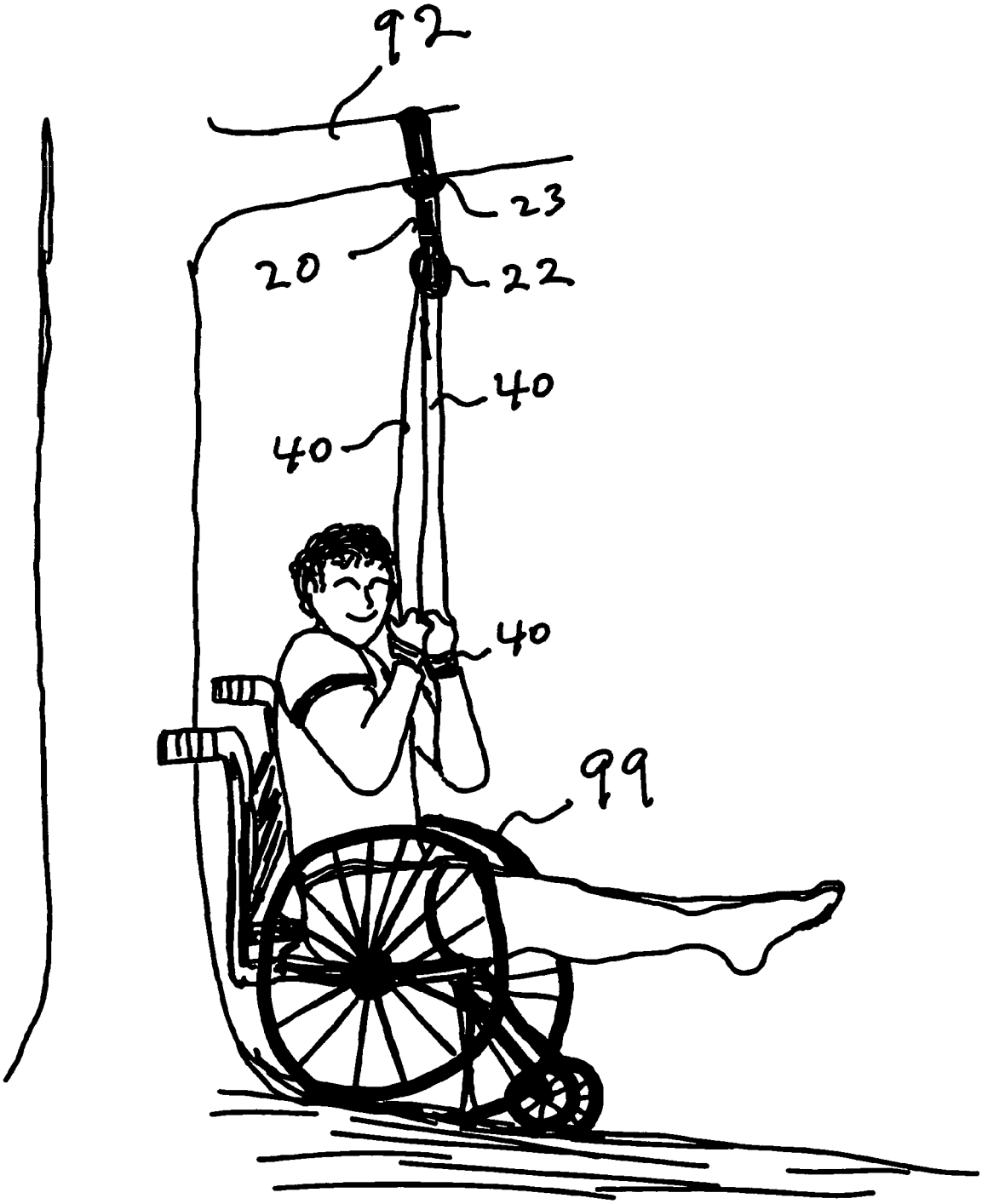

FIG. 25: Using the Yoga Multi-Sling from a Wheelchair

Depicts a strengthening posture that employs the body, the tree branch (92), and the padded sling (40) connected (22) to a non-padded sling (20) in a self-tightening noose (23) from a wheelchair (99).

ADVANTAGES

From the descriptions above, a number of advantages of the method and apparatus of the Yoga multi-sling become evident:

a. Adapts comfortably and safely supports various body sizes and styles through the use of padded Mountain Climbing Spec webbing
b. Is quickly and easily adjustable to a variety of tree diameters and heights of limbs
c. Accommodates multiple types of exercises in order to isolate a large variety of muscles or muscle groups by changing the body's relationship to gravity
d. Is lightweight and fits in a compact, convenient, portable carrying bag
e. Is weatherproof and waterproof which supports exercising in various weather conditions, and is machine washable

CONCLUSIONS AND RAMIFICATIONS a. Encourages connection with nature through outdoor use leading to better health
b. Is reconfigurable and versatile providing endless possibilities of configurations for innovative and creative exercise programs
c. Is configurable to meet physical therapy and exercising needs by providing a motivating, alternative venue for individuals with various handicapping conditions
d. Tree friendly by being non-destructive to tree

SCOPE

Although the descriptions above contain much specificity, these should not be construed as limiting the scope of the embodiments, but as merely providing illustrations of some of the presently preferred embodiments. Thus the scope of the embodiments should be determined by the appended claims and their legal equivalents rather than by the examples given.

We claim:

1. A portable yoga exercise multi-sling kit to enable a person to perform unique yoga exercising postures using said multi-sling attached to a real tree to comfortably support said person's whole body or limbs while practicing said yoga postures on the side of, up in, or next to said real tree, so that said person is altering the orientation of said person's body or said limbs with respect to gravity, in order to employ gravitational forces as the exercising or stretching forces through the positioning of said body, said limbs, and said multi-sling, to create first, second, and third class levers which multiply and focus said forces on targeted muscles or muscle groups; wherein said multi-sling is comprised of a plurality of interlocked, strong, permanently sewn, inelastic, flexible, continuous loop padded and non-padded slings which are free of buckles, connecting members, or external padding; wherein said slings are fabricated using mountain climbing specification nylon tube webbing in order to provide the required safety and strength characteristics for supporting human life; whereby said permanently sewn padded slings are fabricated by encapsulating a flat neoprene rubber pad inside of said mountain climbing specification nylon tube webbing so that said padded slings can be gripped without interference of said external pad; whereby two or more said slings are connected to one another in a parallel interlocking manner or a series interlocking manner; wherein one or more said slings are non-padded that are used to attach to said tree with a self tightening noose, and one or more said slings are padded in order to comfortably support, said person while performing said unique yoga postures in a natural setting.

* * * * *